US009699581B2

(12) United States Patent
Partio et al.

(10) Patent No.: US 9,699,581 B2
(45) Date of Patent: Jul. 4, 2017

(54) DETECTION OF A MICROPHONE

(75) Inventors: Mari Pauliina Partio, Pirkkala (FI); Marko Tapani Yliaho, Tampere (FI); Ari Juhani Koski, Lempäälä (FI); Juha Reinhold Backman, Espoo (FI)

(73) Assignee: Nokia Technologies Oy, Espoo (FI)

( * ) Notice: Subject to any disclaimer, the term of this patent is extended or adjusted under 35 U.S.C. 154(b) by 98 days.

(21) Appl. No.: 14/423,350

(22) PCT Filed: Sep. 10, 2012

(86) PCT No.: PCT/IB2012/054699

§ 371 (c)(1),
(2), (4) Date: Feb. 23, 2015

(87) PCT Pub. No.: WO2014/037766

PCT Pub. Date: Mar. 13, 2014

(65) Prior Publication Data

US 2015/0304786 A1 Oct. 22, 2015

(51) Int. Cl.

| | |
|---|---|
| ***H04R 29/00*** | (2006.01) |
| ***H04R 25/00*** | (2006.01) |
| ***H04R 3/04*** | (2006.01) |

(52) U.S. Cl.

CPC ..... *H04R 29/004* (2013.01); *H04R 3/04* (2013.01); *H04R 25/305* (2013.01); *H04R 29/005* (2013.01); *H04R 2460/05* (2013.01)

(58) Field of Classification Search

None

See application file for complete search history.

(56) References Cited

U.S. PATENT DOCUMENTS

| | | | | |
|---|---|---|---|---|
| 5,822,718 | A | 10/1998 | Bakis et al. | |
| 8,054,991 | B2 | 11/2011 | Tokuda et al. | |
| 2002/0037088 | A1 | 3/2002 | Dickel et al. | |
| 2002/0116187 | A1 * | 8/2002 | Erten | G10L 21/0272 704/233 |
| 2005/0008177 | A1 | 1/2005 | Ibrahim | |
| 2005/0239516 | A1 | 10/2005 | Gonopolskiy | |

(Continued)

FOREIGN PATENT DOCUMENTS

| | | | |
|---|---|---|---|
| TW | 200948166 | A | 11/2009 |
| WO | 2009/130388 | A1 | 10/2009 |

(Continued)

OTHER PUBLICATIONS

"Can I Replace a Cell Phone Microphone", Ehow Contributor, Retrieved on May 11, 2012, Webpage available at : http://www.ehow.com/way_5968748_can-replace-cell-phone-microphone_.html.

(Continued)

*Primary Examiner* — Curtis Kuntz
*Assistant Examiner* — Qin Zhu
(74) *Attorney, Agent, or Firm* — Alston & Bird LLP

(57) ABSTRACT

An apparatus comprising: a detector configured to determine at least one microphone is impaired by analyzing at least one audio signal from the at least one microphone; and an controller configured to determine an indicator based on the determination of the impairment of the at least one microphone; and configured to apply the indicator based on the determination of the impairment of the at least one microphone, such that the at least one audio signal is processed based on the indicator.

19 Claims, 11 Drawing Sheets

(56) References Cited

U.S. PATENT DOCUMENTS

| | | | | |
|---|---|---|---|---|
| 2007/0021958 | A1 | 1/2007 | Visser et al. | |
| 2007/0038441 | A1 | 2/2007 | Inoue et al. | |
| 2008/0226098 | A1 | 9/2008 | Haulick et al. | |
| 2009/0170563 | A1 | 7/2009 | Chen | |
| 2009/0175466 | A1* | 7/2009 | Elko | H04R 3/005 381/94.2 |
| 2009/0196429 | A1 | 8/2009 | Ramakrishnan et al. | |
| 2009/0296946 | A1 | 12/2009 | Zhang | |
| 2010/0081487 | A1 | 4/2010 | Chen et al. | |
| 2010/0150367 | A1* | 6/2010 | Mizuno | G10K 11/1782 381/71.6 |
| 2010/0189292 | A1 | 7/2010 | Wurzbacher et al. | |
| 2010/0278358 | A1 | 11/2010 | Pocino et al. | |
| 2011/0003615 | A1* | 1/2011 | Langereis | G01S 15/04 455/556.1 |
| 2011/0051953 | A1* | 3/2011 | Makinen | H04R 1/406 381/92 |
| 2011/0222698 | A1 | 9/2011 | Asao et al. | |
| 2011/0274302 | A1 | 11/2011 | Isozaki et al. | |
| 2011/0317848 | A1 | 12/2011 | Ivanov et al. | |
| 2012/0008802 | A1* | 1/2012 | Felber | G10L 15/22 381/107 |
| 2012/0070018 | A1 | 3/2012 | Grattan | |
| 2012/0121100 | A1 | 5/2012 | Zhang et al. | |

FOREIGN PATENT DOCUMENTS

| | | |
|---|---|---|
| WO | 2011129725 | 10/2011 |
| WO | WO 2013/144419 A1 | 10/2013 |
| WO | 2014/037765 A1 | 3/2014 |

OTHER PUBLICATIONS

Extended European Search Report received for corresponding European Patent Application No. 12884130.1, dated Feb. 25, 2016, 7 pages.

International Search Report and Written Opinion received for corresponding Patent Cooperation Treaty Application No. PCT/IB2012/054699, dated Aug. 29, 2013, 17 pages.

Office Action for European Patent Application No. 12884130.1 dated Apr. 20, 2017, 5 pages.

* cited by examiner

DETECTION OF A MICROPHONE

RELATED APPLICATION

This application was originally filed as PCT Application No. PCT/IB2012/054699 filed Sep. 10, 2012.

FIELD

The present application relates to apparatus and methods for the detection of impaired microphones and specifically but not only microphones implemented within mobile apparatus.

BACKGROUND

Audio recording systems can make use of more than one microphone to pick-up and record audio in the surrounding environment. Occasionally, the operation of one or more of these microphones may become impaired. For example, a microphone may become blocked, partially blocked, broken or otherwise impaired in operation.

For example, small particles such as dust may become embedded in the microphone leading to a deterioration in the operation of the microphone, a microphone may become blocked or partially blocked by a finger or other body part, a microphone may break or partially break due to a mechanical or other cause and/or a microphone may become impaired due to sound distortion introduced by environmental factors such as wind.

This may lead to a reduction in the quality of the recorded audio.

SUMMARY

According to a first aspect there is provided a method comprising: determining at least one microphone is impaired by analysing at least one audio signal from the at least one microphone; determining an indicator based on the determination of the impairment of the at least one microphone; and applying the indicator based on the determination of the impairment of the at least one microphone, such that the at least one audio signal is processed based on the indicator.

Analysing at least one audio signal from the at least one microphone may comprise determining a signal level of the at least one audio signal from the at least one microphone differs significantly compared to a defined threshold value.

The defined threshold value may be a historical signal level for the at least one microphone.

The signal level may comprise a signal level ratio between at least two frequency band signal levels and wherein the defined threshold value may be a frequency band ratio value.

The at least one microphone may be a first microphone and a second microphone from at least two microphones and analysing at least one audio signal from the at least one microphone may comprise determining a signal level difference between the at least one audio signal from the first microphone of the at least two microphones and at least one further audio signal from the second microphone of the at least two microphones is greater than or equal to a defined threshold value.

Determining a signal level difference may comprise determining a signal level difference greater than or equal to a defined threshold value over a defined period of time.

Determining the signal level difference may comprise: generating at least one signal level difference between the at least one audio signal from the first microphone of the at least two microphones and at least one further audio signal from the second microphone of the at least two microphones for at least one frequency band; comparing the at least one frequency band at least one signal level difference against an associated frequency band threshold value; and determining the first microphone of the at least two microphones is impaired based on the comparison of the at least one frequency band at least one signal level difference being greater than the associated frequency band threshold value.

Determining at least one microphone is impaired by analysing at least one audio signal from the microphone may comprise: generating a histogram comparing a spectral power level for the at least one audio signal from the at least one microphone over time; detecting at least one histogram peak with a value greater than a defined threshold; and determining the position of the detected at least one histogram peak occurs outside a defined normal operational range for the microphone.

The at least one microphone may be a first microphone and a second microphone from at least two microphones, and determining at least one microphone is impaired by analysing at least one audio signal from the microphone may comprise: generating a histogram comparing a spectral power level difference between the at least one audio signal from the first microphone of the at least two microphones and at least one further audio signal from the second microphone of the at least two microphones over time; detecting at least one histogram peak with a value greater than a defined threshold; and determining the position of the detected at least one histogram peak occurs outside a defined normal operational range for the first microphone and the second microphone.

The position of the detected at least one histogram peak may be at least one of: a frequency range bin for a spectral power level difference between the at least one audio signal from the first microphone and at least one further audio signal from the second microphone; and a time period range for a spectral power level difference between the at least one audio signal from the first microphone and at least one further audio signal from the second microphone.

Determining a microphone is impaired may further comprise: determining an object in proximity to at least one microphone port associated with the microphone; and determining the microphone is the impaired microphone based on the determined object.

Determining an indicator based on the determination of the impairment of the at least one microphone may comprise: determining at least one control parameter for the at least one microphone; and determining at least one display parameter for the at least one microphone.

Determining at least one control parameter for the at least one microphone may comprise at least one: determining a first switch control parameter for a first switch configured to receive the audio signal from the at least one microphone; determining a first mixer control parameter for a first mixer configured to receive the audio signal from the at least one microphone; determining a first amplifier control parameter for a first amplifier configured to receive the audio signal from the at least one microphone; and determining a first filter control parameter for a first filter configured to receive the audio signal from the at least one microphone.

Applying the indicator based on the determination of the impairment of the at least one microphone, such that the at least one audio signal is processed based on the indicator may comprise at least one of: applying a first switch control parameter for a first switch configured to receive the audio signal from the at least one microphone; applying a first mixer control parameter for a first mixer configured to receive the audio signal from the at least one microphone; applying a first amplifier control parameter for a first amplifier configured to receive the audio signal from the at least one microphone; and applying a first filter control parameter for a first filter configured to receive the audio signal from the at least one microphone.

Determining an indicator based on the determination of the impairment of the at least one microphone may comprise generating a display message indicating the at least one microphone is impaired and wherein applying the indicator comprises generating on a display the display message.

Applying the indicator may comprise at least one of: an indicator that at least one further microphone signal is selected; and an indicator that the at least one audio signal from the at least microphone is impaired; and wherein the audio signal from the at least one microphone signal is stopped.

Determining at least one microphone is impaired by analysing at least one audio signal from the microphone may comprise determining at least one of: the at least one microphone is partially blocked; the at least one microphone is fully blocked; the at least one microphone is in audio shadow; the at least one microphone is faulty; and the at least one microphone is providing inaccurate data.

According to a second aspect there is provided an apparatus comprising: a detector configured to determine at least one microphone is impaired by analysing at least one audio signal from the at least one microphone; and an controller configured to determine an indicator based on the determination of the impairment of the at least one microphone; and configured to apply the indicator based on the determination of the impairment of the at least one microphone, such that the at least one audio signal is processed based on the indicator.

The detector may comprises a signal level detector configured to determine a signal level of the at least one audio signal from the at least one microphone differs significantly compared to a defined threshold value.

The defined threshold value may be a historical signal level for the at least one microphone.

The signal level may comprise a signal level ratio between at least two frequency band signal levels and wherein the defined threshold value is a frequency band ratio value.

The at least one microphone may be a first microphone and a second microphone from at least two microphones and the detector configured to analyse at least one audio signal from the at least one microphone may comprise a signal level difference determiner configured to determine a signal level difference between the at least one audio signal from the first microphone of the at least two microphones and at least one further audio signal from the second microphone of the at least two microphones is greater than or equal to a defined threshold value.

The signal level difference determiner may be configured to determine a signal level difference comprises determining a signal level difference greater than or equal to a defined threshold value over a defined period of time.

The signal level difference determiner may comprise: at least one frequency band signal level difference generator configured to generate at least one signal level difference between the at least one audio signal from the first microphone of the at least two microphones and at least one further audio signal from the second microphone of the at least two microphones for at least one frequency band; a signal level comparer configured to compare the at least one frequency band at least one signal level difference against an associated frequency band threshold value; and an impaired microphone determiner configured to determine the first microphone of the at least two microphones is impaired based on the comparison of the at least one frequency band at least one signal level difference being greater than the associated frequency band threshold value.

The impaired microphone determiner may comprise: a histogram generator configured to generate a histogram comparing a spectral power level for the at least one audio signal from the at least one microphone over time; a peak value determiner configured to detect at least one histogram peak with a value greater than a defined threshold; and a peak position determiner configured to determine the position of the detected at least one histogram peak occurs outside a defined normal operational range for the microphone.

The at least one microphone may be a first microphone and a second microphone from at least two microphones, and the impaired microphone determiner may comprise: a histogram generator configured to generate a histogram comparing a spectral power level difference between the at least one audio signal from the first microphone of the at least two microphones and at least one further audio signal from the second microphone of the at least two microphones over time; a peak value determiner configured to detect at least one histogram peak with a value greater than a defined threshold; and a peak position determiner configured to determine the position of the detected at least one histogram peak occurs outside a defined normal operational range for the first microphone and the second microphone.

The position of the detected at least one histogram peak may be at least one of: a frequency range bin for a spectral power level difference between the at least one audio signal from the first microphone and at least one further audio signal from the second microphone; and a time period range for a spectral power level difference between the at least one audio signal from the first microphone and at least one further audio signal from the second microphone.

The detector may comprise: a proximity determiner configured to determine an object in proximity to at least one microphone port associated with the microphone; and an impaired microphone detector configured to determine the microphone is the impaired microphone based on the determined object.

The controller may comprise: a control parameter determiner configured to determine at least one control parameter for the at least one microphone; and a display parameter determiner configured to determine at least one display parameter for the at least one microphone.

the control parameter determiner may comprise at least one of: a switch parameter determiner configured to determine a first switch control parameter for a first switch configured to receive the audio signal from the at least one microphone; a mixer parameter determiner configured to determine a first mixer control parameter for a first mixer configured to receive the audio signal from the at least one microphone; an amplifier parameter determiner configured to determine a first amplifier control parameter for a first amplifier configured to receive the audio signal from the at least one microphone; and a filter parameter determiner configured to determine a first filter control parameter for a first filter configured to receive the audio signal from the at least one microphone.

The controller configured to apply the indicator based on the determination of the impairment of the at least one microphone, such that the at least one audio signal is processed based on the indicator may comprise at least one of: a switch configured to applying a first switch control parameter; a mixer configured to apply a first mixer control parameter; an amplifier configured to apply a first amplifier control parameter; and a filter configured to apply a first filter control parameter.

The controller may comprise a display message generator configured to generate a display message indicating the at least one microphone is impaired, and the apparatus comprises a display configured to display the display message.

The indicator may comprise at least one of: an indicator that at least one further microphone signal is selected; and an indicator that the at least one audio signal from the at least microphone is impaired; and wherein the audio signal from the at least one microphone signal is stopped.

The detector may be configured to determine at least one of: the at least one microphone is partially blocked; the at least one microphone is fully blocked; the at least one microphone is in audio shadow; the at least one microphone is faulty; and the at least one microphone is providing inaccurate data.

According to a third aspect there is provided an apparatus comprising: means for determining at least one microphone is impaired by analysing at least one audio signal from the at least one microphone; means for determining an indicator based on the determination of the impairment of the at least one microphone; and means for applying the indicator based on the determination of the impairment of the at least one microphone, such that the at least one audio signal is processed based on the indicator.

The means for analysing at least one audio signal from the at least one microphone may comprise means for determining a signal level of the at least one audio signal from the at least one microphone differs significantly compared to a defined threshold value.

The defined threshold value may be a historical signal level for the at least one microphone.

The signal level may comprise a signal level ratio between at least two frequency band signal levels and wherein the defined threshold value may be a frequency band ratio value.

The at least one microphone may be a first microphone and a second microphone from at least two microphones and the means for analysing at least one audio signal from the at least one microphone may comprise means for determining a signal level difference between the at least one audio signal from the first microphone of the at least two microphones and at least one further audio signal from the second microphone of the at least two microphones is greater than or equal to a defined threshold value.

The means for determining a signal level difference may comprise determining a signal level difference greater than or equal to a defined threshold value over a defined period of time.

The means for determining the signal level difference may comprise: means for generating at least one signal level difference between the at least one audio signal from the first microphone of the at least two microphones and at least one further audio signal from the second microphone of the at least two microphones for at least one frequency band; means for comparing the at least one frequency band at least one signal level difference against an associated frequency band threshold value; and means for determining the first microphone of the at least two microphones is impaired based on the comparison of the at least one frequency band at least one signal level difference being greater than the associated frequency band threshold value.

The means for determining at least one microphone is impaired by analysing at least one audio signal from the microphone may comprise: means for generating a histogram comparing a spectral power level for the at least one audio signal from the at least one microphone over time; means for detecting at least one histogram peak with a value greater than a defined threshold; and means for determining the position of the detected at least one histogram peak occurs outside a defined normal operational range for the microphone.

The at least one microphone may be a first microphone and a second microphone from at least two microphones, and the means for determining at least one microphone is impaired by analysing at least one audio signal from the microphone may comprise: means for generating a histogram comparing a spectral power level difference between the at least one audio signal from the first microphone of the at least two microphones and at least one further audio signal from the second microphone of the at least two microphones over time; means for detecting at least one histogram peak with a value greater than a defined threshold; and means for determining the position of the detected at least one histogram peak occurs outside a defined normal operational range for the first microphone and the second microphone.

The position of the detected at least one histogram peak may be at least one of: a frequency range bin for a spectral power level difference between the at least one audio signal from the first microphone and at least one further audio signal from the second microphone; and a time period range for a spectral power level difference between the at least one audio signal from the first microphone and at least one further audio signal from the second microphone.

The means for determining a microphone is impaired further may comprises: means for determining an object in proximity to at least one microphone port associated with the microphone; and means for determining the microphone is the impaired microphone based on the determined object.

The means for determining an indicator based on the determination of the impairment of the at least one microphone may comprise: means for determining at least one control parameter for the at least one microphone; and means for determining at least one display parameter for the at least one microphone.

The means for determining at least one control parameter for the at least one microphone may comprise at least one of: means for determining a first switch control parameter for a first switch configured to receive the audio signal from the at least one microphone; means for determining a first mixer control parameter for a first mixer configured to receive the audio signal from the at least one microphone; means for determining a first amplifier control parameter for a first amplifier configured to receive the audio signal from the at least one microphone; and means for determining a first filter control parameter for a first filter configured to receive the audio signal from the at least one microphone.

The means for applying the indicator based on the determination of the impairment of the at least one microphone, such that the at least one audio signal is processed based on the indicator may comprise at least one of: means for applying a first switch control parameter for a first switch configured to receive the audio signal from the at least one microphone; means for applying a first mixer control parameter for a first mixer configured to receive the audio signal from the at least one microphone; means for applying a first amplifier control parameter for a first amplifier configured to receive the audio signal from the at least one microphone; and means for applying a first filter control parameter for a first filter configured to receive the audio signal from the at least one microphone.

The means for determining an indicator based on the determination of the impairment of the at least one microphone may comprise means for generating a display message indicating the at least one microphone is impaired and wherein the means for applying the indicator may comprise generating on a display the display message.

The means for applying the indicator may comprise at least one of: means for applying an indicator that at least one further microphone signal is selected: and means for applying an indicator that the at least one audio signal from the at least microphone is impaired; and wherein the audio signal from the at least one microphone signal is stopped.

The means for determining at least one microphone is impaired by analysing at least one audio signal from the microphone may comprise means for determining at least one of: the at least one microphone is partially blocked; the at least one microphone is fully blocked; the at least one microphone is in audio shadow; the at least one microphone is faulty; and the at least one microphone is providing inaccurate data.

According to a fourth aspect there is provided an apparatus comprising at least one processor and at least one memory including computer code for one or more programs, the at least one memory and the computer code configured to with the at least one processor cause the apparatus to at least perform: determining at least one microphone is impaired by analysing at least one audio signal from the at least one microphone; determining an indicator based on the determination of the impairment of the at least one microphone; and applying the indicator based on the determination of the impairment of the at least one microphone, such that the at least one audio signal is processed based on the indicator.

Analysing at least one audio signal from the at least one microphone may cause the apparatus to perform determining a signal level of the at least one audio signal from the at least one microphone differs significantly compared to a defined threshold value.

The defined threshold value may be a historical signal level for the at least one microphone.

The signal level may comprise a signal level ratio between at least two frequency band signal levels and wherein the defined threshold value may be a frequency band ratio value.

The at least one microphone may be a first microphone and a second microphone from at least two microphones and analysing at least one audio signal from the at least one microphone may cause the apparatus to perform determining a signal level difference between the at least one audio signal from the first microphone of the at least two microphones and at least one further audio signal from the second microphone of the at least two microphones is greater than or equal to a defined threshold value.

Determining a signal level difference may cause the apparatus to perform determining a signal level difference greater than or equal to a defined threshold value over a defined period of time.

Determining the signal level difference may cause the apparatus to perform: generating at least one signal level difference between the at least one audio signal from the first microphone of the at least two microphones and at least one further audio signal from the second microphone of the at least two microphones for at least one frequency band; comparing the at least one frequency band at least one signal level difference against an associated frequency band threshold value; and determining the first microphone of the at least two microphones is impaired based on the comparison of the at least one frequency band at least one signal level difference being greater than the associated frequency band threshold value.

Determining at least one microphone is impaired by analysing at least one audio signal from the microphone may cause the apparatus to perform: generating a histogram comparing a spectral power level for the at least one audio signal from the at least one microphone over time; detecting at least one histogram peak with a value greater than a defined threshold; and determining the position of the detected at least one histogram peak occurs outside a defined normal operational range for the microphone.

The at least one microphone may be a first microphone and a second microphone from at least two microphones, and determining at least one microphone is impaired by analysing at least one audio signal from the microphone may cause the apparatus to perform: generating a histogram comparing a spectral power level difference between the at least one audio signal from the first microphone of the at least two microphones and at least one further audio signal from the second microphone of the at least two microphones over time; detecting at least one histogram peak with a value greater than a defined threshold: and determining the position of the detected at least one histogram peak occurs outside a defined normal operational range for the first microphone and the second microphone.

The position of the detected at least one histogram peak may be at least one of: a frequency range bin for a spectral power level difference between the at least one audio signal from the first microphone and at least one further audio signal from the second microphone; and a time period range for a spectral power level difference between the at least one audio signal from the first microphone and at least one further audio signal from the second microphone.

Determining a microphone is impaired may cause the apparatus to perform: determining an object in proximity to at least one microphone port associated with the microphone; and determining the microphone is the impaired microphone based on the determined object.

Determining an indicator based on the determination of the impairment of the at least one microphone may cause the apparatus to perform: determining at least one control parameter for the at least one microphone; and determining at least one display parameter for the at least one microphone.

Determining at least one control parameter for the at least one microphone may cause the apparatus to perform at least one of: determining a first switch control parameter for a first switch configured to receive the audio signal from the at least one microphone; determining a first mixer control parameter for a first mixer configured to receive the audio signal from the at least one microphone; determining a first amplifier control parameter for a first amplifier configured to receive the audio signal from the at least one microphone; and determining a first filter control parameter for a first filter configured to receive the audio signal from the at least one microphone.

Applying the indicator based on the determination of the impairment of the at least one microphone, such that the at least one audio signal is processed based on the indicator may cause the apparatus to perform at least one of: applying a first switch control parameter for a first switch configured to receive the audio signal from the at least one microphone;

applying a first mixer control parameter for a first mixer configured to receive the audio signal from the at least one microphone; applying a first amplifier control parameter for a first amplifier configured to receive the audio signal from the at least one microphone; and applying a first filter control parameter for a first filter configured to receive the audio signal from the at least one microphone.

Determining an indicator based on the determination of the impairment of the at least one microphone may cause the apparatus to perform generating a display message indicating the at least one microphone is impaired and wherein applying the indicator comprises generating on a display the display message.

Applying the indicator may cause the apparatus to perform at least one of: an indicator that at least one further microphone signal is selected; and an indicator that the at least one audio signal from the at least microphone is impaired; and wherein the audio signal from the at least one microphone signal is stopped.

Determining at least one microphone is impaired by analysing at least one audio signal from the microphone may cause the apparatus to perform determining at least one of: the at least one microphone is partially blocked; the at least one microphone is fully blocked; the at least one microphone is in audio shadow; the at least one microphone is faulty; and the at least one microphone is providing inaccurate data.

Embodiments of the present application aim to address problems associated with the state of the art.

SUMMARY OF THE FIGURES

For better understanding of the present application, reference will now be made by way of example to the accompanying drawings in which.

EMBODIMENTS

The following describes in further detail suitable apparatus and possible mechanisms for the provision of the detection of an impaired operation of a microphone. In some embodiments compensation for an impaired operation of a microphone is also described.

A microphone can become blocked or otherwise impaired. This is not always obvious at the time of recording audio and only evident on the audio playback. For example if a user inadvertently blocks a microphone with their finger during audio recording, the blocked microphone will only become obvious to the user on hearing the impaired audio during playback. Additionally a blocked microphone on a telecommunications device such as for example a mobile phone may impair signal processing, such as ambient uplink noise cancellation, that requires input from some of the microphones on the device. In these cases a user will experience a reduction in the quality of the provided audio.

Embodiments may be implemented in an audio system comprising two or more microphones, Embodiments may be implemented to detect a microphone with impaired operation in the audio system and compensate for the impairment where possible. Embodiments may furthermore detect an impaired operation of a microphone by comparing input signals from the microphones in the system and compensate for the impairment where possible. Embodiments may further alert a user to the impairment of the operation of a microphone (for example, that it is blocked) and compensate the audio for the impairment where possible.

In some embodiments it may be determined that the operation of a microphone is impaired when an input signal from that microphone significantly differs from the input signals from the other microphones in the system, and may be where the significant difference is more than an expected variation due to manufacturing variation or directional/positional variation of the microphones. In some embodiments input signals from the microphones may be expected to have similar characteristics if they are operating without impairment. For example, the input signals may be expected to have similar levels and a similar overall spectral balance under normal conditions. Conditions can be considered to be normal when the microphones are operating correctly or as expected.

By comparing the signals from the microphones in the audio system, some embodiments may determine that signal characteristics, such as a signal level and spectral balance, of a microphone is not in line with those of the other microphones in the system.

Some embodiments may further compensate an input signal from a microphone if it is determined that the operation of that microphone is impaired. In some embodiments, it may be determined how the signal from the impaired microphone deviates from an expected signal for the system and the signal can be compensated on this basis.

Figure 1:
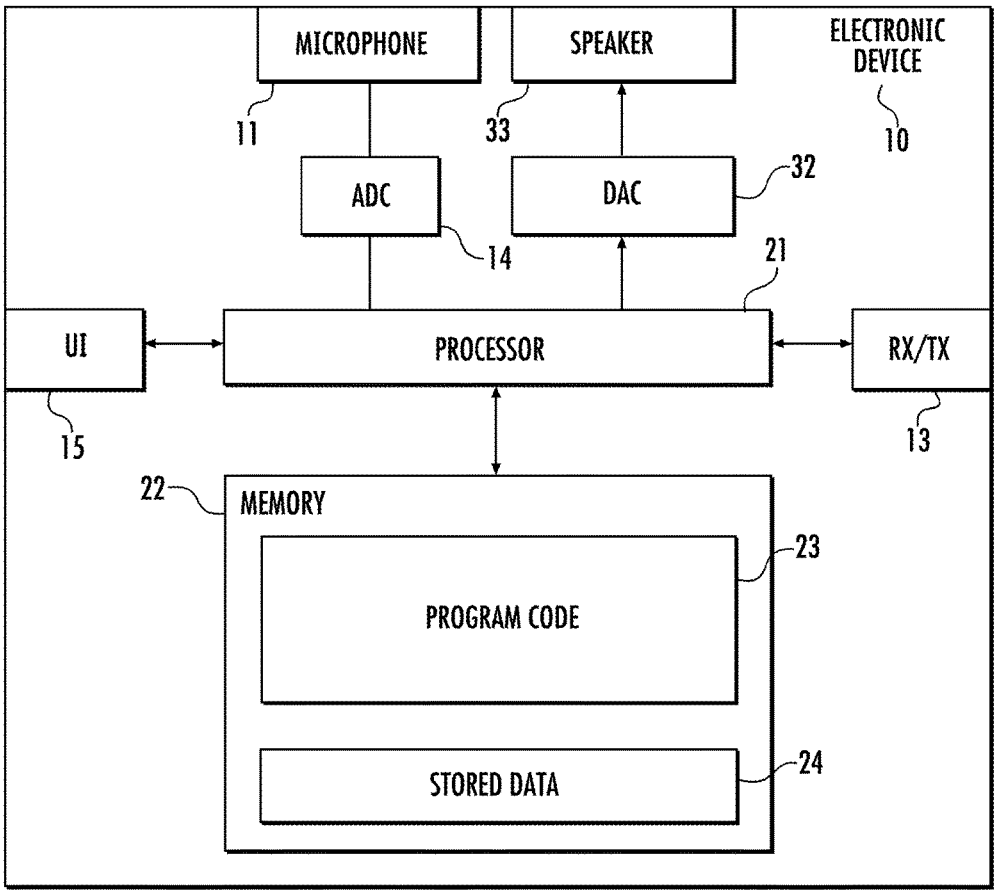
FIG. 1 shows schematically an apparatus suitable for being employed in some embodiments.

FIG. 1 shows an overview of a suitable system within which embodiments of the application can be implemented. FIG. 1 shows an example of an apparatus or electronic device 10. The electronic device 10 may be used to record or listen to audio signals and may function as a recording apparatus.

The electronic device 10 may for example be a mobile terminal or user equipment of a wireless communication system when functioning as the recording apparatus. In some embodiments the apparatus can be an audio recorder, such as an MP3 player, a media recorder/player (also known as an MP4 player), or any suitable portable apparatus suitable for recording audio or audio/video camcorder/memory audio or video recorder.

The apparatus 10 may in some embodiments comprise an audio subsystem. The audio subsystem for example can comprise in some embodiments at least two microphones or array of microphones 11 for audio signal capture. In some embodiments the at least two microphones or array of microphones can be a solid state microphone, in other words capable of capturing audio signals and outputting a suitable digital format signal. In some other embodiments the at least two microphones or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or micro electrical-mechanical system (MEMS) microphone, in some embodiments the microphone 11 is a digital microphone array, in other words configured to generate a digital signal output (and thus not requiring an analogue-to-digital converter). The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means. In some embodiments the microphones are 'integrated' microphones containing both audio signal generating and analogue-to-digital conversion capability.

In some embodiments the apparatus 10 audio subsystems further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio subsystem can comprise in some embodiments a speaker 33. The speaker 33 can in some embodiments receive the output from the digital-to-analogue converter 32 and present the analogue audio signal to the user. In some embodiments the speaker 33 can be representative of multi-speaker arrangement, a headset, for example a set of headphones, or cordless headphones.

Although the apparatus 10 is shown having both audio capture and audio presentation components, it would be understood that in some embodiments the apparatus 10 can comprise only the audio capture part of the audio subsystem such that in some embodiments of the apparatus the microphones (for audio capture) are present.

In some embodiments the apparatus 10 comprises a processor 21. The processor 21 is coupled to the audio subsystem and specifically in some examples the analogue-to-digital converter 14 for receiving digital signals representing audio signals from the microphone 11, and the digital-to-analogue converter (DAC) 12 configured to output processed digital audio signals. The processor 21 can be configured to execute various program codes. The implemented program codes can comprise for example audio recording and microphone defect detection routines.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been recorded or analysed in accordance with the application. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15, The user interface 15 can in some embodiments comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling.

The coupling can be any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

It is to be understood again that the structure of the electronic device 10 could be supplemented and varied in many ways.

The concept of the embodiments described herein is the ability to detect an impaired operation of a microphone in an audio system. Thus in some embodiments, an impairment to a microphone may be detected by comparing an input signal from that microphone to input signals received from other microphones in the audio system, A comparison may be made between one or more characteristics of a signal input from a microphone.

The operation of a microphone may be impaired when the input of a microphone is blocked, partially blocked, broken, partially broken and/or distorted by external environmental factors such as wind. In some cases the microphone can be impaired by a temporary impairment, for example a user's fingers when holding the apparatus in a defined way and over the microphone ports. In some other cases the microphone can be impaired in a permanent manner, for example dirt or foreign objects lodged in the microphone ports forming a permanent or semi-permanent blockage. In some embodiments the impairment detection can by operating over several instances handle both temporary and permanent impairment.

In the following description the term impaired, blocked, partially blocked or shadowed microphone would be understood to mean an impaired, blocked, shadowed or partially blocked mechanical component associated with the microphone. For example a sound port or ports associated with the microphone or microphone module. The sound ports, for example, are conduits which are acoustically and mechanically coupled with the microphone or microphone module and typically integrated within the apparatus. In other words the sound port or ports can be partially or substantially shadowed or blocked rather than the microphones being directly blocked or shadowed. In other words the term microphone can be understood in the following description and claims to define or cover a microphone system with suitably integrated mechanical components, and suitably designed acoustic arrangements such as apertures, ports, cavities. As such the characteristics of a microphone output signal can change when any of the integration parameters are impaired or interfered with. Thus a blocking or shadowing of a microphone port can be considered to be effectively the same as a blocking or shadowing of the microphone.

The concept of embodiments described herein may include adjusting the processing of signals received from the microphones in such an audio system in order to compensate for the impairment of a microphone.

Figure 2:
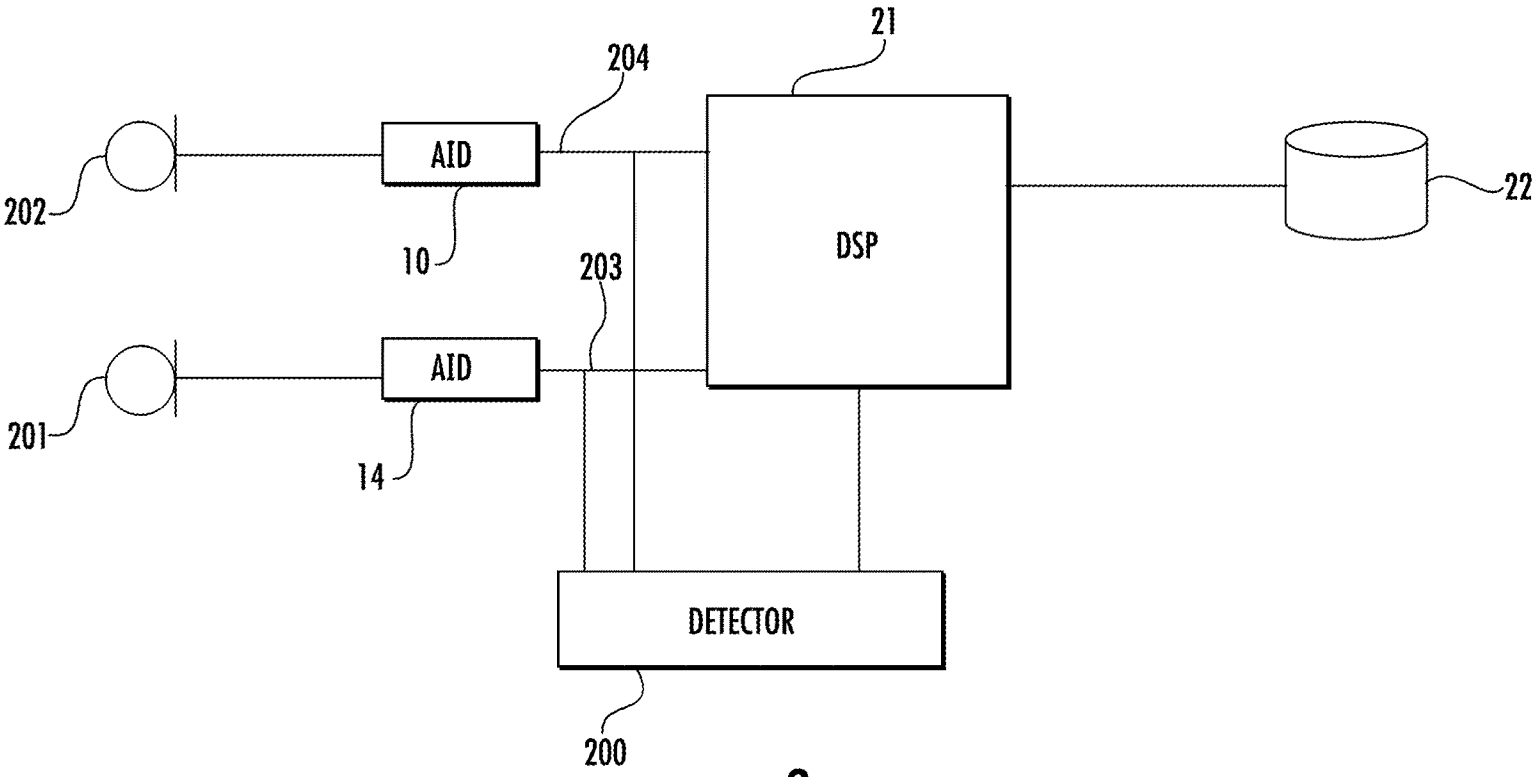
FIG. 2 shows schematically an example of a detector system according to some embodiments.

FIG. 2 shows an example of an audio system in which embodiments may be implemented. It will be appreciated that some of the features of FIG. 2 may correspond to features of the electronic device 10 of FIG. 1 and like reference numerals have been used in such cases.

FIG. 2 comprises a first microphone 201 and a second microphone 202. It will be appreciated that the first and second microphones 201 and 202 may form part of the microphone 11 of FIG. 1. The first microphone 201 and the second microphone 202 may be configured to listen to and/or pickup audio in a surrounding environment and provide a representation of this audio as an analogue signal to analogue to digital converters 14 coupled to the first and second microphones 201 and 202. It will be appreciated that this is by way of example only and in some embodiments the first and second microphones 201 and 202 may include analogue to digital conversion functionality and output a digital representation of the audio data.

The analogue to digital converters 14 may provide a first input signal 203 to a processor 21 from the first microphone 201 and a second input signal 204 to the processor 21 from the second microphone 202, The first input signal 203 may be representative of the audio picked up by the first microphone 201 and the second input signal 204 may be representative of the audio picked up by the second microphone 202. The processor 21 may be coupled to a memory 22.

In addition to the first and second microphones 201 and 202, the processor 21 and the memory 22, a detector 200 may be provided. The detector 200 may be coupled to receive the first input signal 203 and the second input signal 204 from the first microphone 201 and the second microphone 202. The detector 200 may further be coupled to the processor 21. It will be appreciated that this by way of example and in some embodiments, the detector 200 may form part of the functionality of the processor 21.

In operation, the detector 200 may receive the first input signal 203 and the second input signal 204 from the first and second microphones 201 and 202 and determine whether the operation of one or more of the microphones 201 and 202 is impaired. The detector 200 may further provide an indication to the processor 21 that an impairment has been detected. Alternatively or additionally, the detector 200 (independently or as part of the functionality of the processor 21) may carry out or initiate an action to be taken in response to a detection of impaired operation.

It will be appreciated that while the audio system of FIG. 2 has been illustrated as comprising two microphones 201 and 202, this is by way of example only and more than two microphones may be implemented. In some embodiments, the audio system may provide an omnidirectional audio functionality and may include four or more microphones.

Figure 3:
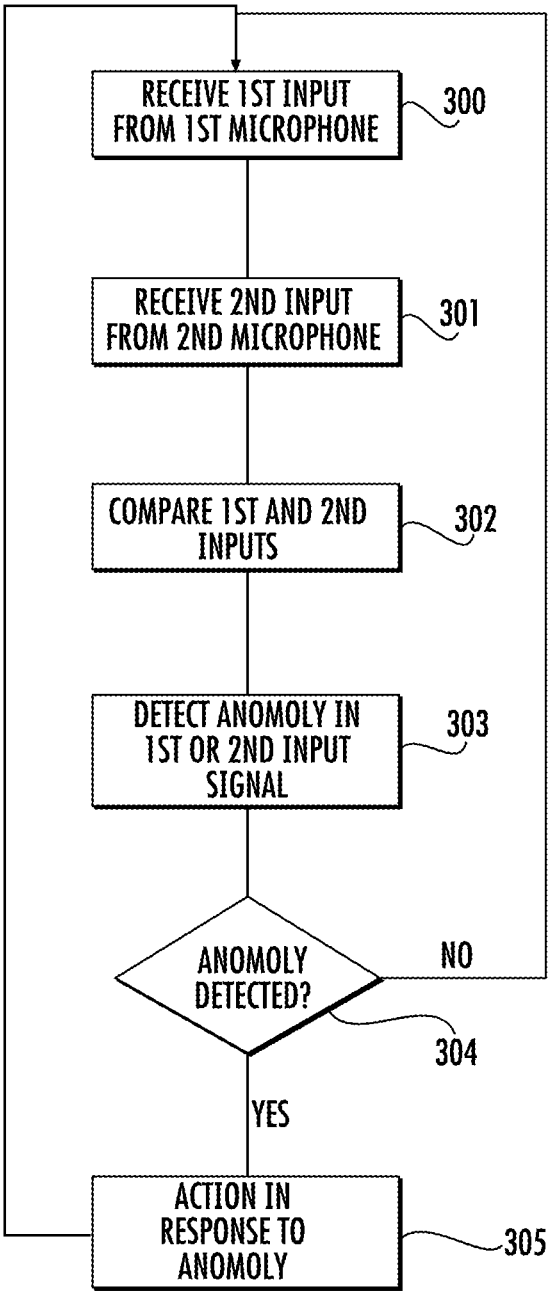
FIG. 3 shows schematically a flow diagram of the operation of a detector of an audio recording system as shown in FIG. 2 according to some embodiments.

FIG. 3 shows a flow diagram depicting an example of the method steps that may be carried out by the detector 200 and/or the processor 21 FIG. 2.

At step 300 a first input signal 203 from a first microphone 201 is received. At step 301 a second input signal 204 from a second microphone 202 is received. It will be appreciated that further inputs from further microphones may be received in other embodiments. Additionally it will be appreciated that while steps 303 one have been depicted as being successive, they may be carried out in reverse order or simultaneously.

At step 302 the first input signal 203 and the second input signal 204 are compared in order to determine whether they have similar characteristics. For example, under normal operation of the microphones 201 and 202, it may be expected for the first and the second input signals 203 and 204 to have a similar signal level and/or a similar overall spectral balance. If the signal level and/or spectral balance of the first and second input signal 203 and 204 are not in line, this can be considered an anomaly.

At step 303, the results of the comparison may be processed in order to determine if there is an anomaly in the characteristics of the first or second input signals 203 and 204. It will be appreciated that while the comparison of step 302 and detection of step 303 have been depicted as independent steps, they may be carried out in a single step or processing by the detector 200.

The method then progresses to step 304, where it is determined whether an anomaly in one of the input signals is detected. If no anomaly has been detected, it can be determined that the microphones are operating normally and the method returns to step 300. If an anomaly is detected the method may progress to step 305. At step 305 an action is taken in response to the detected anomaly.

The action to be taken at step 305 may include alerting a user to the detection of an impaired operation of a microphone and/or may include providing some compensation for the impairment in order to maintain the quality of the received audio.

In some embodiments alerting a user to a detected impairment in operation of a microphone may include providing an indication to the user that an impairment has been detected by for example showing a warning message on a display means of the device 10, playing a warning tone, showing a warning icon on the display means and/or vibrating the device. In other or additional embodiments, the alert to the user may take the form of informing a user of the detected impairment by contacting the user via electronic means for example by email and/or a short messaging service (SMS) requesting that the device 10 is brought in for a service. The contacting may include in some embodiments information relating to service points where the device may be serviced.

In some embodiments the display or suitable visual user interface output means can be configured to provide the indication that impairment has been detected or that one of the microphones is operating correctly.

Figure 8A:
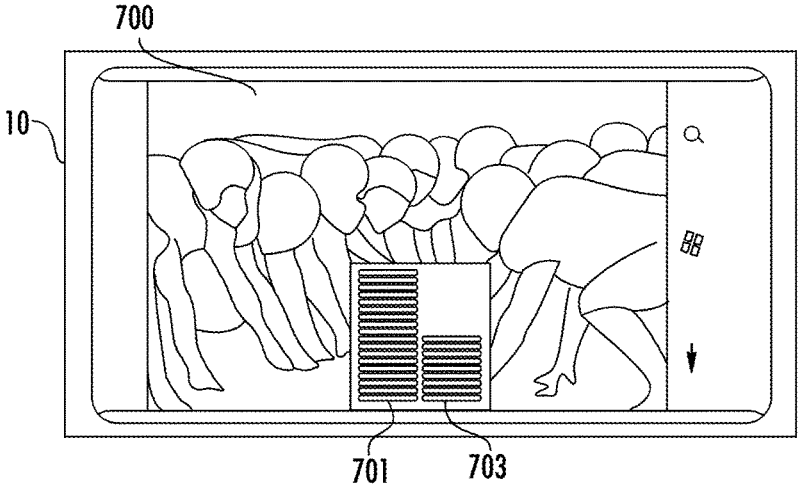
FIGS. 8*a*, 8*b*, and 8*c* show user interface representations of impaired microphone operation according to some embodiments.
Figure 8B:
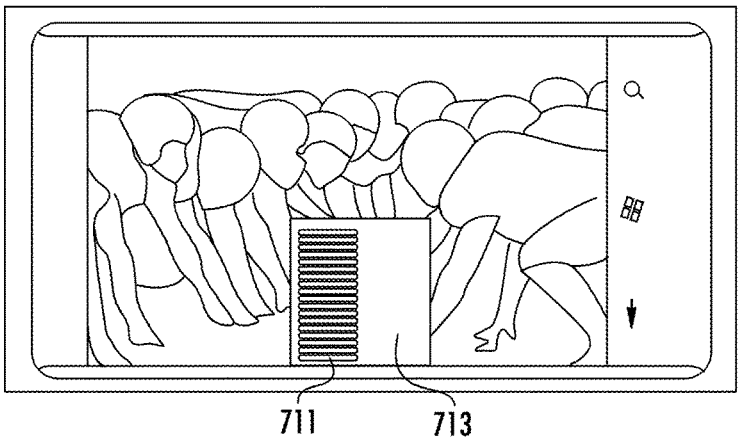
Figure 8C:
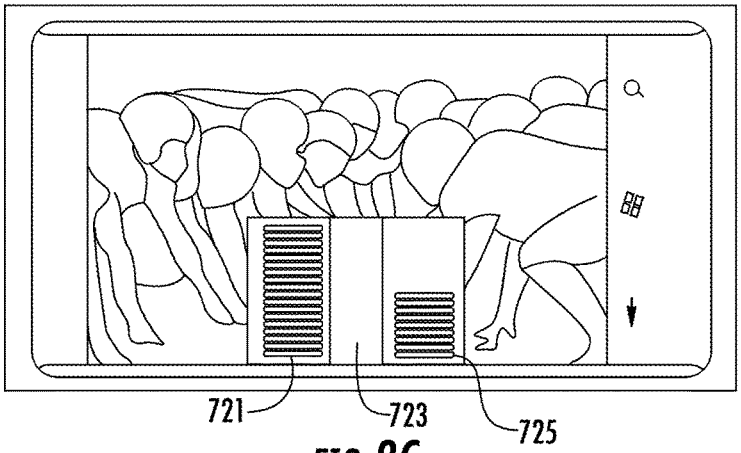

For example FIGS. 8*a* to 8*c* show an example display output with an example display configuration according to some embodiments suitable for providing indication to a user.

With respect to FIG. 8*a* the apparatus 10 is shown recording an event which is shown visually on the display 700. Furthermore the audio recording from a stereo capture (recording) of the event is shown or indicated on the display 700 by a signal level meter for both microphones separately.

With respect to FIG. 8*a* the display shows a functional left microphone signal level meter indicator 701 and a functional right microphone signal level meter indicator 703.

In FIG. 8*b* the apparatus 10 is shown recording the same event but when one of the microphones are impaired. In other words one of the microphones is in such a condition/situation that recording or capture is not possible (for example the microphone is broken or blocked or distorted due to wind noise), In this example the functional left microphone signal level meter indicator 711 is shown and an impaired right microphone indicator 713 is shown where the indicator shows an empty indicator with no indication about the signal level. In other words in some embodiments the display is configured to output visual indication only about the captured signal.

In some embodiments the visual indication can permit the apparatus to switch to recording double mono. In other words the left microphone signal is copied and used as the right channel signal. In some embodiments where the microphone's impairment is temporary, for example the microphone or conduit leading to the microphone is being blocked, then the apparatus can be configured to switch back to the original stereo capture and stereo signal level meter when the impairment ends. In some embodiments a time delay between switching can be implemented to avoid continuous swapping or switching between mono and stereo recordings.

In FIG. 8*c* the apparatus 10 is shown recording the same event but when one of the microphones are impaired and there is stereo recording or capture and a signal level meter for each microphone. In the example shown in FIG. 8*c* there are redundant microphones in case one of the microphones is impaired or in such a condition/situation that recording or capture is not possible. Thus the functional left microphone signal level meter indicator 721 is shown, the impaired right microphone indicator 723 is shown where the indicator shows an empty indicator with no indication about the signal level and the switched in third (redundancy) microphone signal level meter indicator 725 is shown that could replace the usage of the impaired or non-functional microphone.

In some embodiments the user interface can be configured to display only the functional microphones in such a redundancy switching. For example in some embodiments the display output following a switching of microphones would be similar to that shown in FIG. 8*a* where the functional left microphone signal level meter indicator is shown and the switched third microphone signal level indicator is shown.

In some embodiments the display can be configured to indicate that a non-default microphone is being used. In some embodiments there can be displayed more than two or three microphone signal level indicators. For example in some embodiments there can be displayed a surround sound capture signal level meter for each of the five non-LFE channels. In some embodiments where one of the microphones is determined to be impaired or non-functional, the signals can be downmixed which is can be represented on the display by the five channel signal level meter "downmixed" to a stereo signal level meter indicating the signal levels for the stereo track being recorded or captured simultaneously. It would be understood that in some embodiments the number of microphones used as an input can be more than or fewer than three and the number of input channels can be more than or fewer than five and the number of downmixed channels output can be more than or fewer than two (where the number of downmixed channels is less than the number of input channels).

In some embodiments where the apparatus is configured to receive audio signals from four or more microphones then an impaired or non-functional microphone can be replaced by a functional microphone such that the apparatus can continue to record or capture a multichannel signal.

Figure 9:
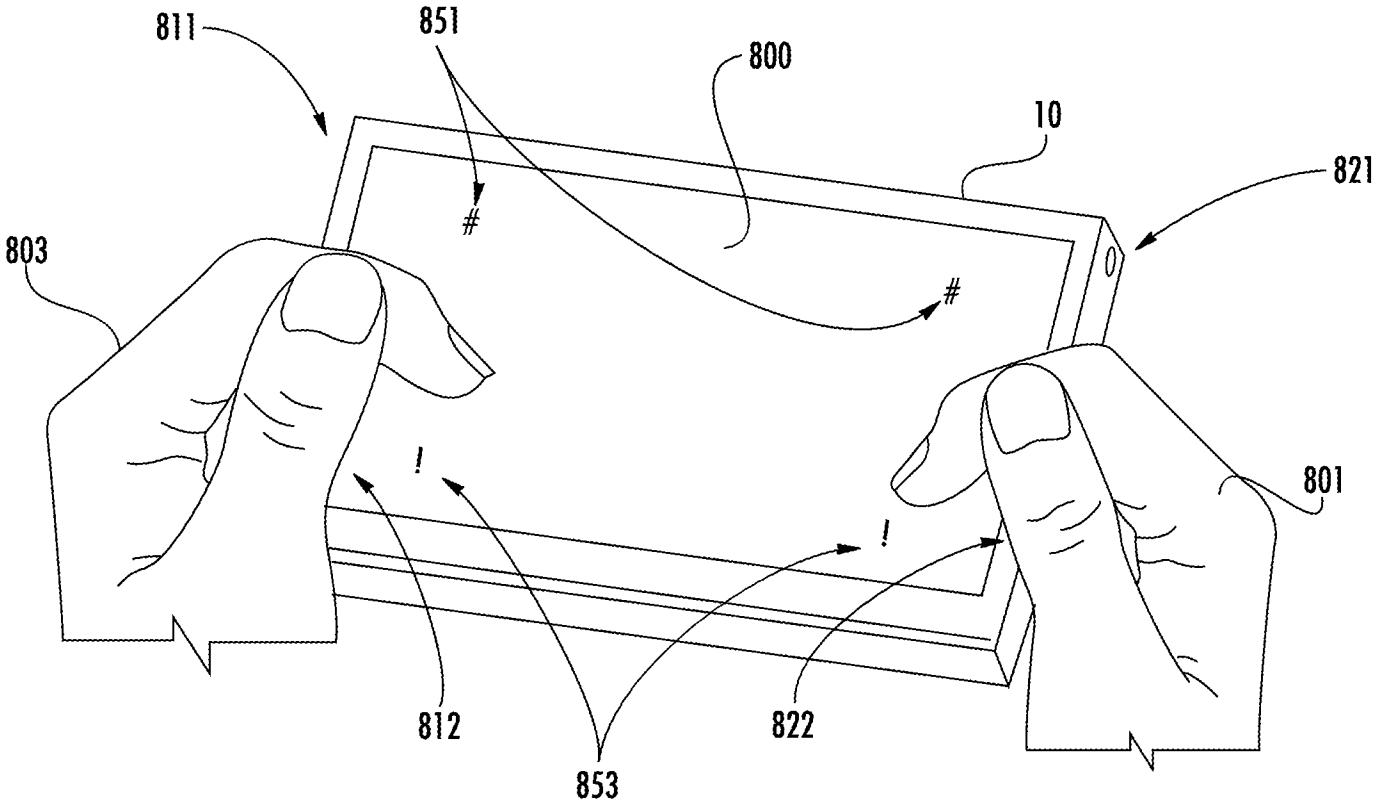
FIG. 9 shows a further user interface representation of impaired microphones caused by user operation according to some embodiments.

In some embodiments the indicator can be configured to modify the user's habits, such as the way the user is holding the apparatus. For example a user may hold the apparatus 10 and one or more of microphones may be blocked by the user's fingers. For example, such as shown in FIG. 9 a user holding the apparatus 10 may have a grip such that the user's left hand 803 blocks the third microphone 812 and the user's right hand 801 blocks the second microphone 821. In the case where audio is being recorded in the first mode, with the first microphone 811 and the second microphone 821 being active, some embodiments may determine or detect that the active microphones 821 has been blocked and switch the functionality of that active microphone 821 with one of the passive microphones 812 and 822. Furthermore, in some embodiments, on determining that the third microphone 812 is also blocked then the fourth microphone 822 is selected. In some embodiments the indicator can further be used to determine or select microphone or audio signal processing parameters. These can in some embodiments be equalisation or signal processing parameters to acoustically tune the input audio signals. However in some embodiments these parameters can be associated with the location or distribution of the microphones selected. For example in some embodiments where a distance and relative direction between the microphone inputs is required, for example in directional analysis of the input audio signals, then the indicator can be used not only to select the functional microphone but generate, determine or select the microphone related distance and relative direction parameters used in processing the audio signals.

Figure 10:
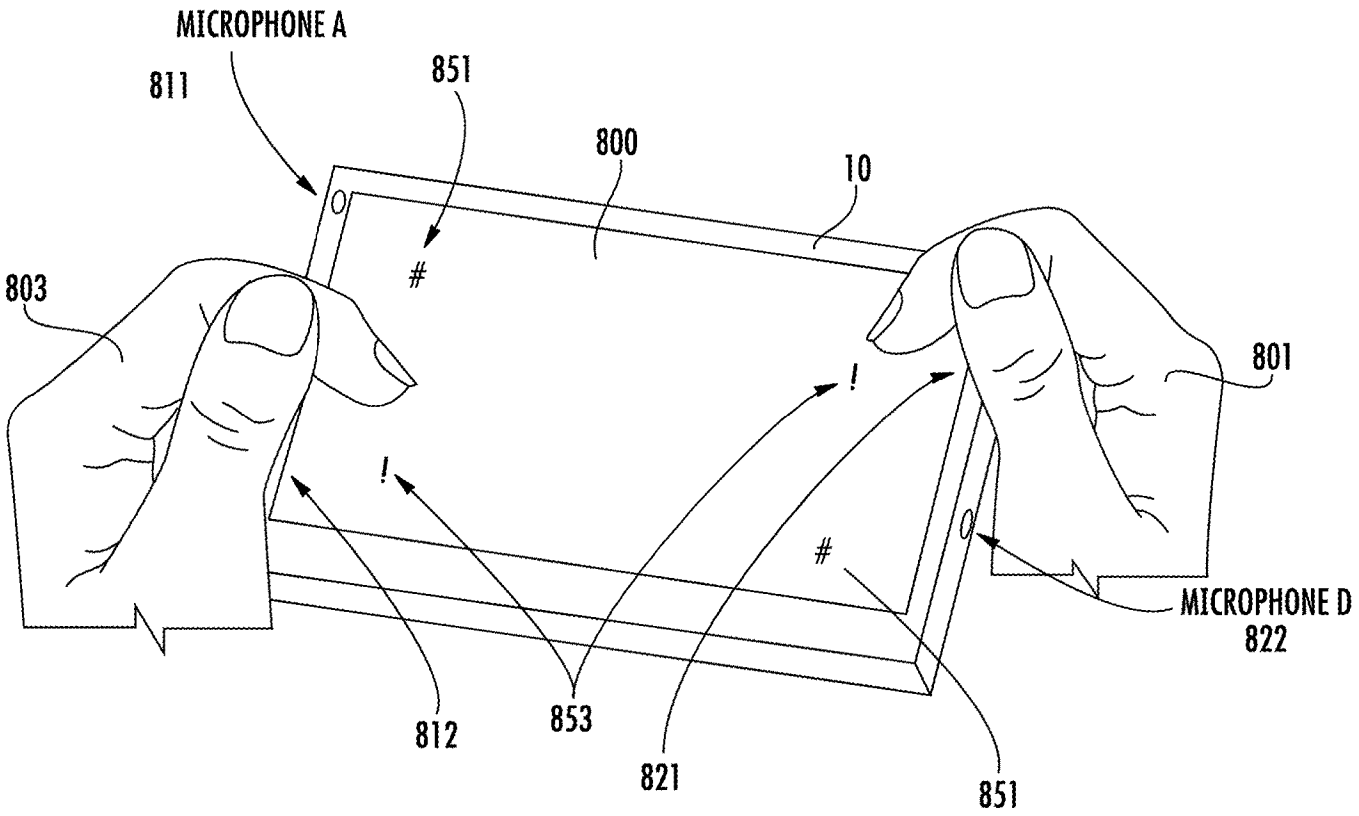
FIG. 10 shows the further user interface representation of impaired microphone caused by user operation where the user has moved their hands according to some embodiments.

As shown in FIGS. 9 and 10 in some embodiments the apparatus can display the at least one microphone operational parameter on the display. In the example shown in FIGS. 9 and 10 the apparatus is shown displaying information that the microphones are either functional by generating a '#' symbol (or graphical representation) representing that the microphones are functional and generating a T symbol (or graphical representation) representing that the microphones are blocked or in shadow due to the user's fingers. R would be understood that in some embodiments the location of the symbol or graphical representation can be in any suitable location. For example in some embodiment the symbol or graphical representation can be located on the display near to the microphone location. However in some embodiments the symbol or graphical representation can be located on the display at a location near to the microphone location but away from any possible 'touch' detected area—otherwise the displayed symbol or graphical representation may be blocked by the same object blocking the microphone.

In some embodiments the apparatus or any suitable display means can be configured to generate a graphical representation associated with the microphone operational parameter; and determine the location associated with the microphone on the display to display the graphical representation. For example the apparatus can be configured in some embodiments to generate a graphical representation associated with the microphone operational parameter which comprises at least one of: generating a graphical representation of a functioning microphone for a fully functional microphone, such as the '#' symbol shown in FIGS. 9 and 10, generating a graphical representation of a faulty microphone for a faulty microphone, such as an image of a microphone with a line though it, generating a graphical representation of a blocked microphone for a partially blocked microphone, such as the T symbol shown in FIGS. 9 and 10, and generating a graphical representation of a shadowed microphone for a shadowed microphone.

It would be understood that in some embodiments the displayed graphical representation or symbol can be used as a user interface input. For example where the display shows a partially blocked or faulty microphone the user can touch or hover touch the displayed graphical representation to send an indicator to the control unit to control the audio signal input from the microphone (in other words switch the microphone on or off, control the mixing of the audio signal, control the crossfading from the microphone etc.).

In some embodiments the indicator and therefore the displayed graphical representation or symbol can be based on the use rather than the physical microphones.

Figure 11A:
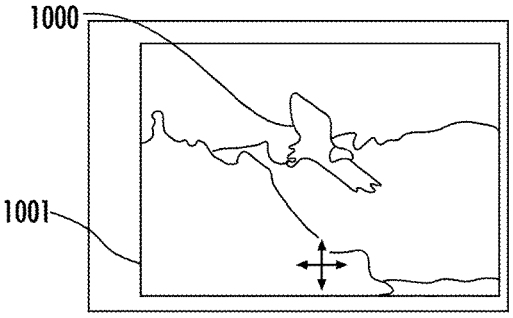
FIGS. 11*a* to 11*f* show user interface representations of impaired microphone indication according to some embodiments.
Figure 11B:
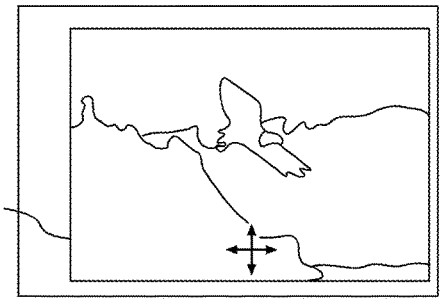
Figure 11C:
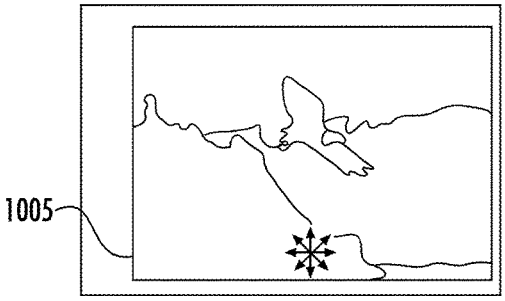

Thus for example as shown in FIGS. 11*a* to 11*c* a series of user interface examples are shown where the apparatus is configured to record the object as shown in the display, the bald eagle 1000, and the background or environmental noises surrounding the object. In FIG. 11*a* the apparatus is configured to display a graphical representation of a functional object based audio recording or capture use, by the bright/white multidirectional arrow 1001. In FIG. 11*b* the apparatus is configured to display a graphical representation of a poorly or non-functioning object based audio recording or capture use, by the dark/greyed out multidirectional arrow 1003. It would be understood that in some embodiments the graphical representation can show degrees of functionality between fully functional object based audio recording to no object based audio recording. In FIG. 11*c* a different graphical representation of a poorly or non-functioning object based audio recording or capture use, by the multidirectional arrow with a cross through it 1005.

Figure 11D:
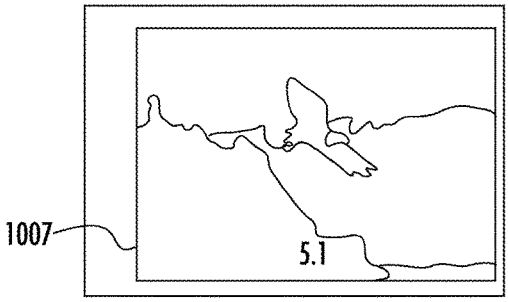
Figure 11E:
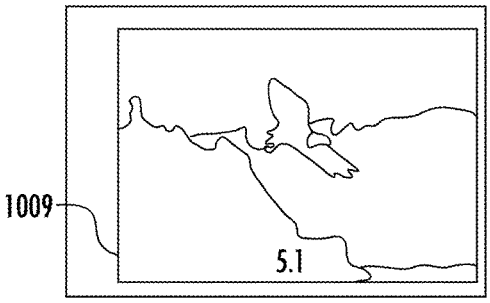
Figure 11F:
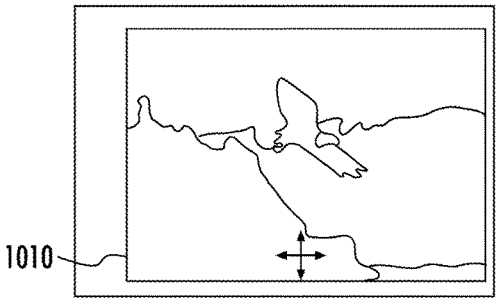

It would be understood that any suitable use or recording graphical representation can be generated and displayed. For example FIGS. 11*d* to 11*e* show text based graphical representations similar to those examples shown in FIGS. 11*a* to 11*c*. In FIG. 11*d* the apparatus is configured to display a graphical representation of a functional surround sound recording or capture use, by the bright/white text indicating the recording format—5.1 1007. It would be understood that the recording format could be any suitable recording format and the text representation generated accordingly. In FIG. 11*e* the apparatus is configured to display a graphical representation of a poorly or non-functioning surround sound recording or capture use, by the dark/greyed out text indicating the recording format 1009. It would be understood that in some embodiments the graphical representation can show degrees of functionality between fully functional surround sound recording to no surround sound recording for example by various shades of grey. In FIG. 11*f* a different graphical representation of a poorly or non-functioning surround sound recording or capture use, by the text indicating the recording format with a cross through it 1010.

Although in the examples shown in FIGS. 11*a* to 11*f* the graphical representation is shown as a grey scale indication it would be understood that coloured versions of graphical indication or text indications of the use can be implemented. For example a green graphical representation can indicate a good recording and a red graphical representation or red cross through a green graphical representation can indicate a poor or non-functional recording.

In some embodiments, compensating audio data for the impairment may include amplifying the input signal from the impaired microphone to compensate for attenuation of the signal due to the impairment, changing the recording mode of the device 10 to make use only of at least some of the operational microphones, for example switching a recording mode from a stereo mode to a mono or double mono mode, replace the functionality of the impaired microphone with an additional microphone and/or adjusting a signal level and/or timbre of the impaired input signal to compensate for the impairment. Audio capture algorithms of the audio system may also be adjusted in response to the type of compensation applied.

In some embodiments, the action to be taken may depend on the type of impairment detected. For example, the detector 200 may detect whether a microphone is blocked, broken or audio picked up by the microphone is distorted due to environmental factors such as a strong wind on the microphone. In some embodiments, characteristics of the impaired signal may be used to determine the type of impairment and the determined type of impairment may be used to determine the action to be taken in response to the detected impairment.

For example, a physical obstacle (such as a finger) partially blocking a microphone port may cut off high frequencies of the input signal but have little or no effect on an overall level and low frequencies of the input signal. Fully blocking a microphone port may have an effect on the overall level of an input signal but a lesser effect on the low frequencies of the signal. In these two cases, the higher frequencies, lower frequencies and overall gain may be attenuated to address the impairment. In other examples, it can be determined that a microphone is broken if no audio data is provided by the input signal of the microphone. In this case, in some embodiments, an alert may be made to the user and/or an indication that a service is needed. In additional or alternative embodiments, a period of time for which the anomaly is present may be determined and a determination of whether the microphone is broken or blocked may be based on this.

The detector 200 may carry out the comparison and detection of the anomaly. In one embodiment the detector 200 may carry out the comparison based on the levels of one or more characteristics of the signal. In another embodiment the detector 200 may carry out the compensation using histogram data of the input signals from the microphone.

Figure 4:
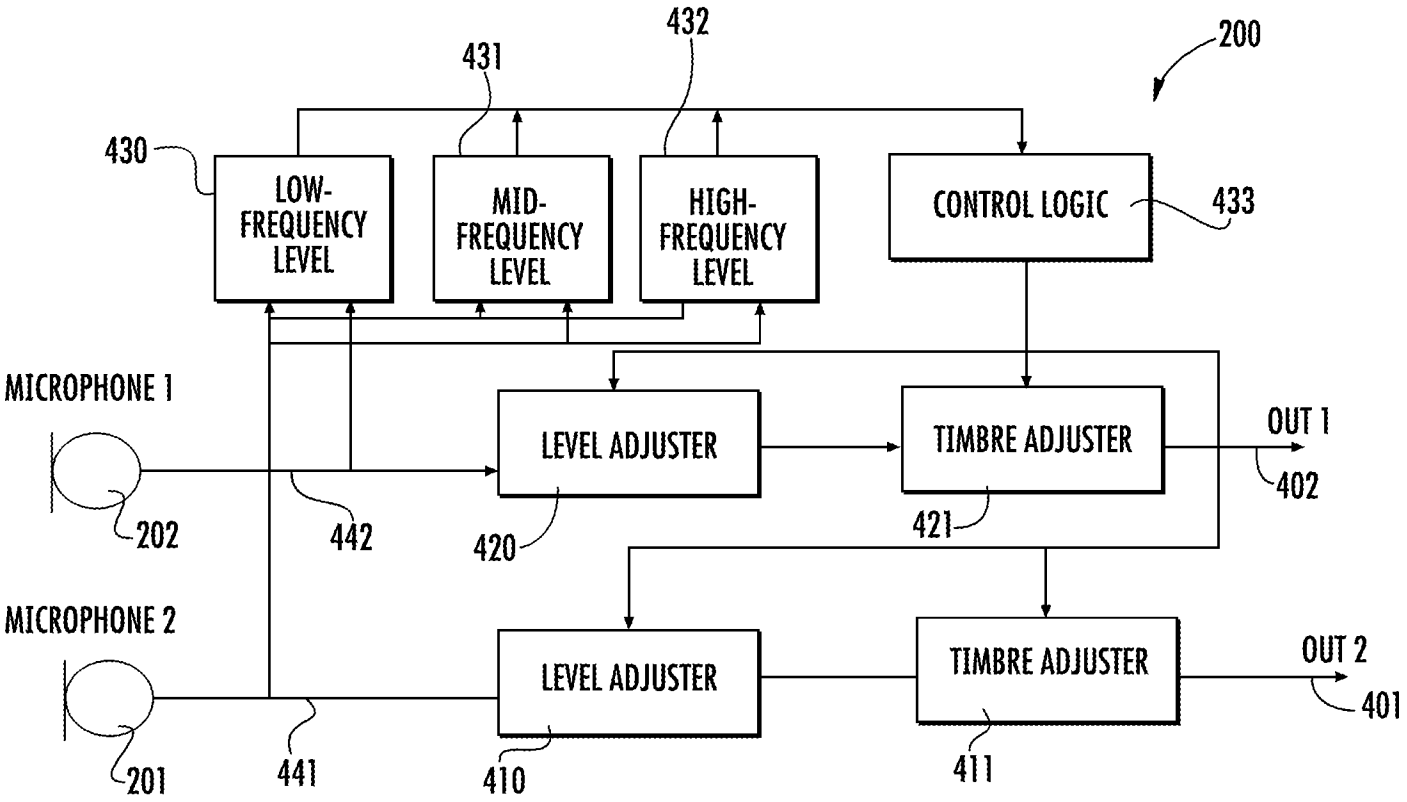
FIG. 4 shows schematically a further example of a detector system according to some embodiments.

FIG. 4 shows an embodiment in which level analysis is carried out in order to detect an anomaly. In the embodiment of FIG. 4, the input signals are adjusted in response to a detected anomaly. This may response to the action taken in step 305 of FIG. 3. It will however be appreciated that this is by way of example only and any suitable action may be taken in response to the detected anomaly. It will be appreciated that some of the features of FIG. 4 are similar to those of FIG. 2 and like reference numerals may represents like features.

The audio system of FIG. 4 may comprise a first microphone 201 and a second microphone 202 coupled to a detector 200. The first microphone 201 may be coupled to a first signal processing path of the detector 200 comprising a first level adjuster 410 and a first timbre adjuster 411. The second microphone 202 may be coupled to a second processing path of the detector comprising a second level adjuster 420 and a second timbre adjuster 421. The first processing path may provide an output signal 401 which may correspond to a signal 441 input from the first microphone 201 and compensated by the first level and timbre adjusters 410 and 411. Similarly, the second processing path may provide a second output signal 402 which may correspond to an input signal 442 from the second microphone 202 and compensated by the second level and timbre adjusters 420 and 421.

The first input signals 441 and second input signal 442 from the first and second microphones 201 and 202 may further be provided to a low-frequency level detector 430, a mid-frequency level detector 431 and a high-frequency level detector 432. It would be understood that in some embodiments any suitable number of defined band detectors can be employed. For example in some embodiments the detector comprises a single full-band level detector. In some other embodiments the detector may comprise more than one frequency band defined detector. For example in some embodiments the detector may comprise a defined narrower frequency band detector and a defined wider frequency detector, each detector configured to detect over a separate, partial or fully overlapping frequency range.

The low-frequency level detector 430, mid-frequency level detector 431 and high-frequency level detector 430 may provide an output to a control logic 433. The control logic 433 may be coupled to provide control signals to the first and second level adjusters 410 and 420 and to the first and second timbre adjusters 411 and 421.

In operation, the first and second microphones 201 and 202 may pick up audio signals within the surrounding environment and convert them into digital signals as the first and second input signals 441 and 442 to be provided to the detector 200. It will be appreciated that in some embodiments analogue to digital converters may be provided to convert an analogue output of the first and second microphones 201 and 202 into digital signals for the detector 200. In other embodiments the first and second microphones 201 and 202 may include analogue to digital conversion functionality and provide digital signals directly.

The first and second input signals 441 and 442 may be provided to the low-frequency level detector 430, mid-frequency level detector 431 and the high-frequency level detector 432. It will be appreciated that while detectors corresponding to three frequency ranges are depicted in FIG. 4, in some embodiments detectors for only one or more frequency ranges may be provided. In some embodiments, detectors for additional or different frequency ranges may be provided.

The low frequency level detector 430 may receive the first input signal 441 and the second input signal 442 and carry out a comparison between the low frequency components of the first input signal 441 and the second input signal 442 in order to detect whether they are within an acceptable range of each other. If the low frequency components of one of the input signals 441 and 442 is determined to fall outside an acceptable range, for example if one of the input signals have low frequency components having a much lower level than the other low frequency components, the low frequency level detector 430 may determine that the low frequency components of one of the input signals is experiencing impairment. In other words, that the operation of one of the microphones is impaired. The low frequency level detector 430 may provide an indication of this to control logic 433.

Similarly to the low frequency level detector 430, the mid-frequency level detector 431 may receive the first input signal 441 and the second input signal 442 and compare a level of the mid-frequency components of each of the signals to determine whether they are within an acceptable range of each other. If it is determined that the mid-frequency components of one of the signals differs greatly from the other signal, it may be determined that the operation of one of the microphones is impaired. For example, that the microphone is blocked or broken. The mid-frequency level detector 431 may provide an indication of this to the control logic 433.

Similarly, the high frequency level detector 432 may receive a first input signal 441 and the second input signal 442 from the first and second microphones 201 and 202. The high frequency level detector 432 may carry out a comparison between the high frequency components of each of the input signals 441 and 442 and determined whether they are in an acceptable range of each other. If it is determined the high frequency components of one of the input signals differs greatly from the other, then the high-frequency level detector 432 may determine that the operation of one of the microphones is impaired in such a way that the high frequency component generated by that microphone is attenuated. The high frequency level detector 432 may provide an indication of this to the control logic 433.

The control logic 433 may receive indications corresponding to each of the input signals as to whether a low frequency, mid-frequency or high-frequency component of the signal is attenuated due to impairment in the operation of the corresponding microphone. In some embodiments the control logic may use these indications to determine the type of impairment experienced by the microphone.

For example, if the high frequency component of the first input signal 441 is attenuated but the mid-frequency and low frequency component is within a range of the second input signal 442, the control logic 433 may determine that the first microphone 201 is partially blocked. The control logic 433 may then determine the course of action to take in response to this. For example, in the embodiment of FIG. 4, the audio system may implement compensation in order to make up for the attenuation of the high frequency components generated by the first microphone 201. The control logic 433 may do this by providing control information to the first level adjuster 410 and first timbre adjuster 411 to adjust the level and the timber of the first input signal 441. In other words, the control logic 433 may provide control input to the signal processing path of the first input signal 441 in order to compensate for the microphone port been partially blocked.

In another example, if an indication from the mid-frequency level detector 431 indicates the mid-frequency component of the second input signal 442 is attenuated while the low frequency detector 430 indicates little or no attenuation in the low frequency component of the second input signal 442 in compared to the first input signal 441, the control logic 433 may determine that the second microphone 202 port is completely blocked. The control logic 433 may then provide control information to the second level adjuster 420 and the second timbre adjuster 421 in order to compensate for the blocked microphone port.

The adjustment carried out by the level and timbre adjusters may be such that the input signal is compensated for any attenuation caused by the impairment of the microphone. For example, in the first case where a partial blocking of the first microphone is detected, the control logic may issue control information to the first level adjuster 410 to adjust the high frequency level of the first input signal 441 with a suitable equaliser (for example a shelving filter with a turning frequency brought lower along with an increase in boost). If a complete block, for example in the second example, the control logic 433 may provide control information to the second processing path in order to boost the overall levels of the second signal 442 and a low frequency reduction may be applied according to the difference between the level of the low frequency components and overall level measurements of the second input signal 442. This may be in order to prevent excessive boosts of the lowest frequency components.

In another example, the detector 200 of FIG. 4 may detect that all the microphone ports have been blocked. For example, a user may have inadvertently covered both the first microphones 201 and the second microphone 202 in holding the electronic device 10. In this case the control logic 433 may analyse the indications from the low frequency detector 430, the mid-frequency level detector 431 and the high frequency level detector 432 to analyse an overall spectral balance of both the first and second input signals 441 and 442. If the control logic detects that the levels of the low frequency components are proportionally out of balance to the mid-frequency and high frequency component levels, it may determine that all of microphone port are blocked.

It will be appreciated that the first and second microphones 201 and 202 have been given by way of example only. In some embodiments more than two microphones may be available. In some embodiments, even if further microphones are not used in recording, information from these microphones may be used in the detection of any impairment nonetheless. These additional microphones may provide a level for a spectral balance reference. For example highest average median levels from all the microphones may be used to determine a reference level.

It will be appreciated that three detectors 430, 431 and 432 are by way of example only. In additional other embodiments, other or different frequency bands may be analysed with corresponding equaliser structures in the processing path which may be designed for more precise spectral balancing.

In some embodiments the control logic 433 may be configured to only implement compensation after impairment has been detected for a certain period of time. This may be useful in the case where the microphone is only briefly blocked, for example by a user's finger. Additionally in some embodiments the control logic 433 may be configured such that the compensation is removed at a first indication that a blocking has been removed. This may avoid a compensation being carried out once blocking has been removed from microphone port.

It will be appreciated that the detectors 430, 431 432 may analyse the levels of the received first and second input signals for 441 and 442 in any suitable manner.

For example, in one embodiment, the samples available on the first and second signals 441 and 442 may be summed over a period of time. The sum of the first input signal samples and the sum of second input signal samples may be compared in order to determine if they are in a range of each other. In the embodiment of FIG. 4, the samples corresponding to the frequency range of the relevant detector 430, 431 and 432 may be summed. For example low-frequency level detector 430 may sum the samples corresponding to low frequency component of the input signals 441 and 442.

In another embodiment, the levels of the first input signal 441 and the second input signal 442 may be calculated. The levels of the first input signal 441 and second input signal 442 can be calculated using any suitable method. For example a level or spectral difference can be calculated related to the use case. Furthermore in some embodiments the average identical signals can be when the apparatus (phone) is used for capturing sound sources at least a few apparatus size distances away. In some embodiments a near-field use (telephony, etc.) the baseline level difference is non-zero, and should be determined according to other available information (for example usage, proximity detectors, touch sensors etc.), or with histogram based methods described herein later.

For example in some embodiments the apparatus can be configured with a touch sensitive surface. In some embodiments the touch sensitive surface can extend past the display surface. For example the sensors can directly cover the apparatus edges using edge touch detectors or indirectly by detecting hovering touch for the main screen. In such embodiments the touch sensors can provide an indication or warning that a finger or other potentially blocking object is close to a microphone port. It would be understood that in embodiments where the sensors are not precise enough to determine if the port is really blocked then this indicator can be used as a first of a series of detection operations or steps where using additional sensors can activate the acoustics-based blocking detection algorithm. Furthermore in some embodiments the use of the touch screen can be used to determine where multiple microphones are blocked simultaneously as the acoustics detector operation would have difficulty indicating a positive blocking result in such cases.

A threshold may be determined which corresponds to an acceptable range of differences between the levels of the first input signal 441 and the second input signal 442 when both microphones are operating correctly. If the difference between the levels of the two signals is bigger than this threshold value, the detector 200 may provide an indication to the control logic 433 that action must be taken as impairment has been detected.

In some embodiments the time over which the levels are calculated or summed may not be static but based on a size of a difference between the two signals. For example, if the difference between the two signals is relatively small, the samples may continue to be summed or the levels continued to be calculated before providing an indication that impairment has been detected. In other embodiments, if the difference between the two signals is great then the time period for determining that impairment has been detected may be reduced. This may provide some allowance to disregard spurious signals.

Figure 5:
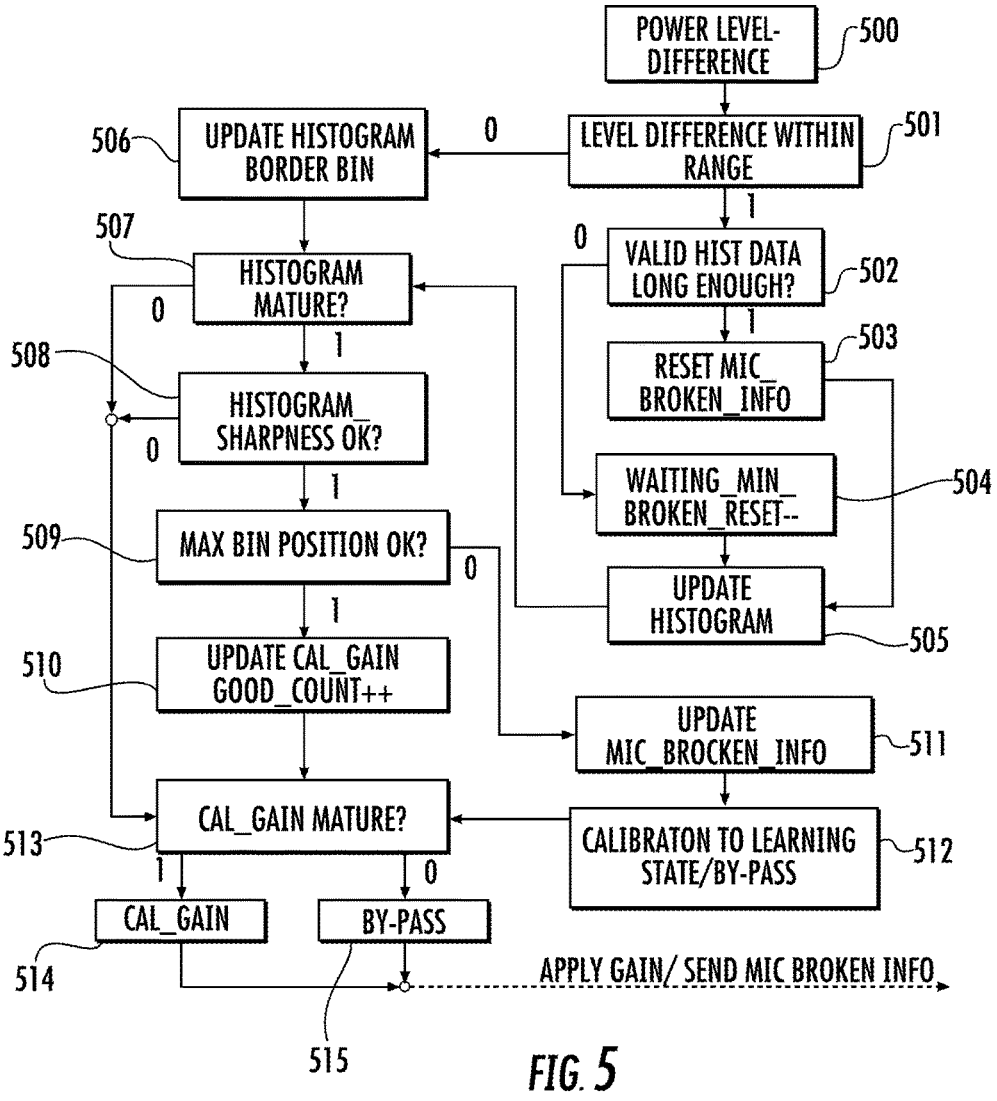
FIG. 5 shows schematically a further flow diagram of the operation of a histogram detector according to some embodiments.
Figure 6:
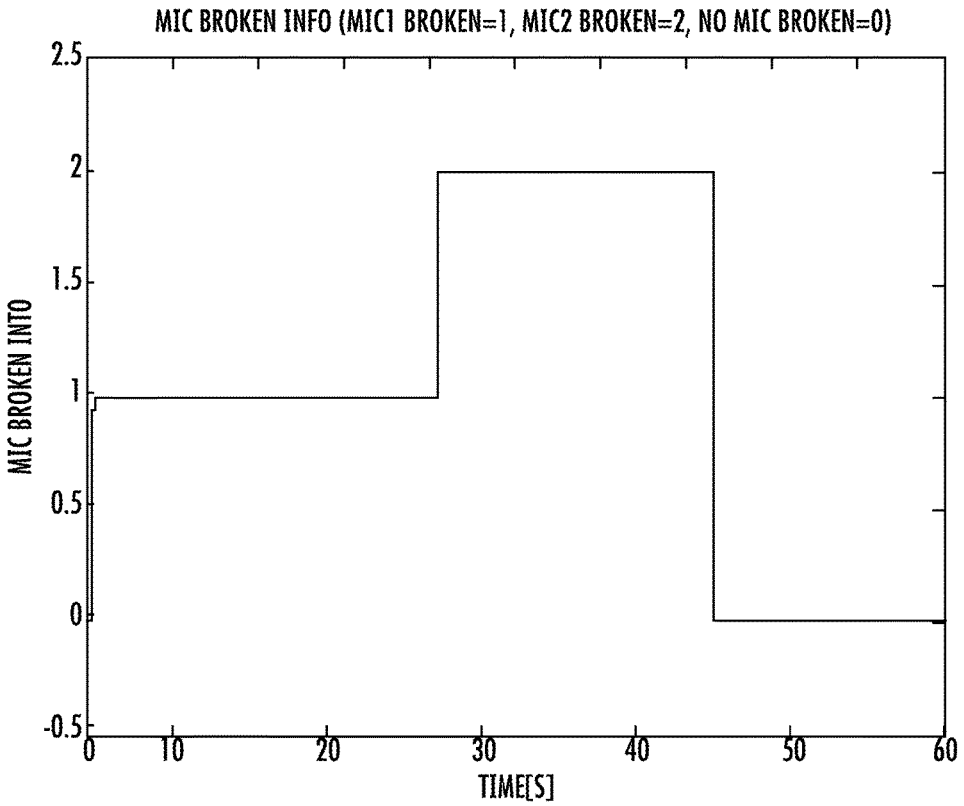
FIG. 6 shows schematically an example of an example microphone signal showing broken/blocked operation.
Figure 7:
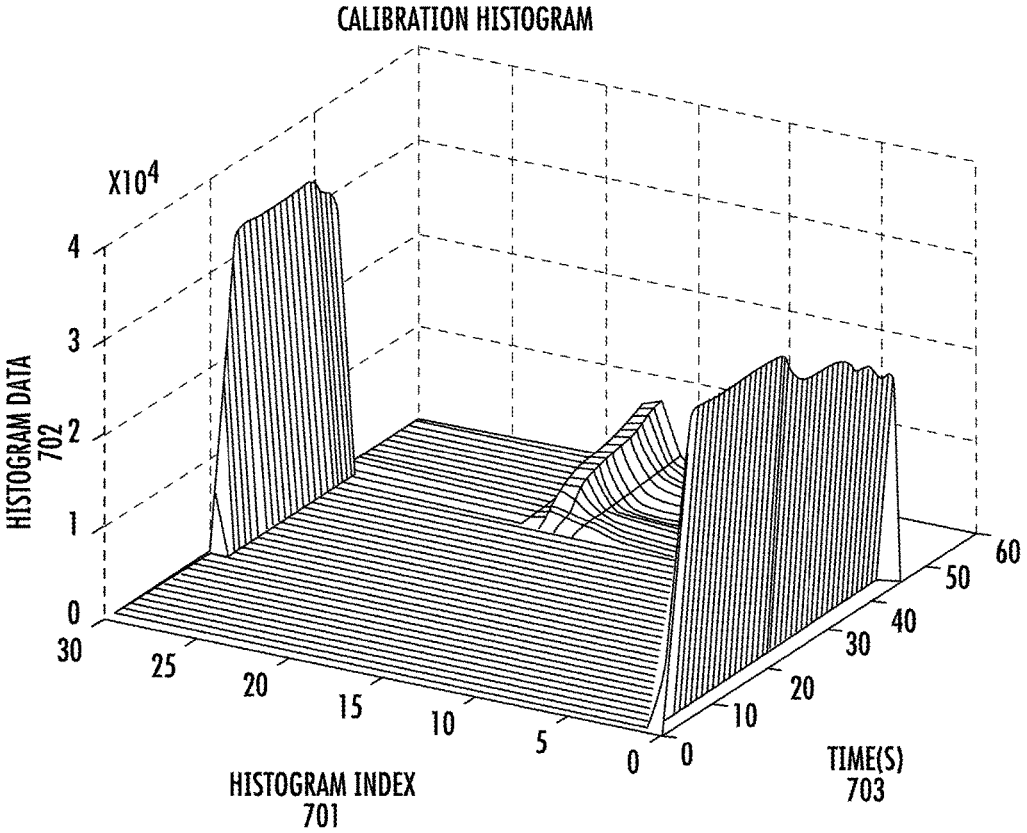
FIG. 7 shows a calibration histogram for an example simulated broken microphone.

In a further embodiment, a detection of an impairment of operation of a microphone may be carried out through use of a histogram. FIGS. 5 to 7 show an example of detecting such impairment through use of a histogram.

Histograms may be used in the calibration of microphones in an audio system. There may typically be a sensitivity difference of a few decibels between microphones even from the same manufacturing batch. This difference may be due to process variations between the microphones and their supporting components. For some audio processing, it may be necessary to calibrate the microphones in the audio system if a balance between the microphones is required. For example, some audio systems may make use of beamforming in order to more accurately capture a voice audio, Beam-forming may require the levels of the microphones to be balanced and is one example in which microphones may be calibrated using a histogram. It will be appreciated however that calibration using a histogram may be carried out for various purposes and in some embodiments, a histogram may be generated solely for detecting impaired operation of a microphone.

Embodiments may make use of a histogram recording the distribution of differences in the power levels between the first and the second microphones 201 and 202. The histogram may be created by measuring the differences in the power level of the first and the second microphones 201 and 202 over time and inputting this data in the histogram. The histogram may depict the distribution of the power differences over a series of equally sized intervals or bins corresponding to the power difference. As the histogram is matured, in other words as the histogram receives more and more data, the bin corresponding to a static sensitivity difference between the first and second microphone (for example due to process variation) will peak. If the sensitivity difference between the microphones is static the histogram will sharpen, allowing a clear peak in the maximum bin.

The data input to the histogram may be screened to neglect spurious data measurements or measurements effected by external influences. For example it may be determined whether a measurement falls within an acceptable or expected range and if not, the measurement is discarded. In embodiments, data outside the expected range may be used to create the histogram in order to recognise when a microphone has impaired operation. The bins falling outside the expected range for the sensitivity difference between the microphones may be called border bins.

In some embodiments using a histogram to determine an impairment of a microphone, it may be determined whether a power level difference measurement falls within one of the border bins of the histogram. In this case it can be determined that one of the microphones is impaired. Additionally a distribution value for the border bins may be defined to be satisfied before it is determined that a microphone has impaired operation. This may account for spurious measurements or momentary spikes in difference due to for example a gust of wind.

FIG. 5 shows an example of the method carried out in the detection of impairment of the microphone using a histogram. It would be appreciated the method of FIG. 5 may be carried out by a detector similar to the detectors of FIG. 4 may be used to compensate signal similar to that carried out of it before. It will be appreciated that this is by way of example only in any action may be taken in response to a determination that microphone has been impaired. In some embodiments the method of FIG. 5 may be carried out by the detector 200 or processor 21 of FIG. 1.

In such embodiments where blocking of a microphone does not result in sensitivity difference greater than that allowed by the calibration algorithm, then blocking can be compensated through calibration. Furthermore in some embodiments where the sensitivity difference becomes greater than that allowed by the calibration algorithm, then this information can be saved in the histogram border bins and the calibration algorithm is not used for compensating the difference.

At step 500 a power level difference between the first and the second signal 203 and 204 is calculated. It will be appreciated that the power level difference may be determined by level analysers and, for example, by the summing of samples of the signals and/or by a calculation of the power levels. At step 501 it is determined whether the power level difference calculated at step 500 is with an expected sensitivity difference range of the two microphones. This range may correspond to an expected difference between the power level of the two microphones if both microphones operating correctly under normal conditions.

If the level difference is within the expected range the method progresses to step 502 where it is determined whether the enough data has been collected in order to determine that the microphones are operating correctly. For example, it may be desired to collect a series of power level differences before determining that microphone is operating correctly in order to take into account any spurious measurements that may occur.

If enough data has been collected to make a determination, the method progresses to step 503

At steps 503 and 504 the operation waits some time (until waiting_mic_broken_reset becomes 0) to be sure valid data is provided long enough before the determination of whether the microphone is fixed/unbocked. For example in some embodiments at step 503 information about the broken microphone is reset. In other words in some embodiments the histogram border bins are emptied, the mic_broken_info is set to 0 and waiting_mic_broken_reset value is set to a default value. Where in some embodiments the valid histogram data has not been received for long enough then the algorithm can proceed to step 504 where counter waiting_mic_broken_reset is decreased.

From step 503 and step 504, the method progresses to step 505 where the power level difference calculated at step 500 is used to update the histogram. The method then progresses to step 507.

If, at step 501, it is determined that the power level difference is outside the range expected for normal operation of the microphones, the method progresses to step 506. At step 506 the border bins of the histogram are updated with the power level data. The border bins may be considered to be the bins of the histogram failing outside the expected range of normal operation of the microphones. The method then progresses to step 507.

At step 507 it is determined whether the histogram is mature. In other words it is determined whether the histogram has received enough data to accurately reflect the difference between power levels between the two microphones.

Where the histogram is mature then the algorithm passes to Step 508. Step 508 determines if the histogram is sharp enough. In other words is the data in the histogram concentrated enough in one bin or two/three immediately neighbouring bins. Where the data is concentrated enough then the algorithm passes to Step 509.

At step 509 a maximum bin position is checked. Where the maximum bin position is neither of the border bins, then data is determined to be valid for calibration and algorithm proceeds to step 510 (which increases calibration maturity counter (cal_gain_good_count)) and then passes to step 513, otherwise the algorithm proceeds to step 511 to update mic_broken_info based on the data in histogram border bins and then pass to step 512.

At step 512 the calibration algorithm is set to an immature state and the algorithm does not try to compensate sensitivity differences between microphones since the difference is outside the tolerated range. The algorithm then in some embodiments proceeds to step 513 where the algorithm checks whether the calibration gain is mature. This calibration gain maturity step is also accessible in some embodiments from failures in the checks for steps 507 and 508 and from step 510. If the calibration gain is mature, then the gain can be applied to the second microphone signal, Otherwise if the calibration gain is immature then calibration is set to a bypass mode (shown in step 515) and information about broken/blocked microphone could be utilized in further processing.

The operation of the determination of an impairment in the operation of a microphone will further be described with reference to FIGS. 6 and 7.

FIG. 6 shows an example of the impaired operation of the microphones over time. The x-axis of FIG. 6 corresponds to time and the y-axis corresponds to microphone broken information. A microphone broken information value of 1 indicates that the first microphones broken, a value of 2 indicates that the second microphone is broken and a value of 0 indicates that both microphones are operating correctly. Between 0 and 20 seconds the first microphone is impaired, between 20 and 40 seconds the second microphone is impaired and between 40 and 60 seconds both microphones operate correctly.

FIG. 7 shows an example of a histogram corresponding to the operating of the first and second microphones as depicted in FIG. 6.

The z-axis 703 FIG. 7 corresponds to the time in seconds the y-axis 702 corresponds to histogram data and the x-axis 701 corresponds to a histogram index or bins. For example an expected range of the power level difference between the first and second microphones under normal operating conditions may be considered to be between the 1 and 29 index, usually between 5 and 25 index. The border bins may be seen at index 30 and 0.

It can be seen from FIG. 7, that between 0 and 20 seconds, when the first microphone is broken, the distribution of the difference between the power level of the first and second microphones falls in the border bin at the 0 index. Between 20 and 40 seconds, when the first microphone operates correctly and the second microphone is broken, the distribution fails in the border bin at the 30 index. It can be seen from this that in the first instance the power level of the first microphone is much lower than the power level of the second microphone and in the second instance that the power level of the second microphone is a lot lower than the power level of the first microphone. Between 40 and 60 seconds both microphones operate correctly and it can be seen that the distribution of the difference lies around the 15 index for this period of time. It can be seen from this, that the distribution of the histogram indicated the operation of the microphones.

In the example shown in FIG. 7 there should be some delay for correct detection to enable enough data to be collected in the histogram before the values for mic_broken_info based on it can be obtained. Therefore, where a detection of first microphone being broken can occurs just after 0 seconds, and detection of second microphone being broken a can occur just after 20 seconds, whereas detection of correct operation occurs just after 40 seconds. This 'delay' can in some embodiments depend on tuning parameters.

It would be understood that histogram based methods for broken/blocked microphone detection is not limited to two microphones, but it can be applied for any number of microphone pairs using at least some of the microphones as a reference microphone.

Similarly it would be understood that histogram analysis can reveal some single-microphone failures. For example where the microphone analogue to digital (A/D) converter or input amp sensitivity drops, then a significant amount of signal below the typical noise floor and an increase in noise floor (electronics failure, contamination, etc.) would produce a situation where there is not any signal close to the typical noise floor. Furthermore in some embodiments where a similar histogram analysis is performed over multiple frequency bands, then a blocked microphone could be indicated by producing only signals close to the electronics and transducer noise floor in the highest frequency range.

In some embodiments the information concerning broken/blocked microphone detection results could be analysed by the apparatus or transmitted to a server suitable for storing information on the failure modes of microphones.

For example the server can in such circumstances gather information on the failure modes in an effective accelerated lifetime test which would enable rapid re-development of future replacement apparatus or improved versions of the apparatus.

Furthermore such embodiments by incorporating system-level field failure data, the apparatus can be configured to determine that only certain failure modes (either component failure or temporary misuse) have any practical importance and in such embodiments the apparatus can avoid implementing a very complex detection algorithm.

It shall be appreciated that the electronic device 10 may be any device incorporating an audio recordal system for example a type of wireless user equipment, such as mobile telephones, portable data processing devices or portable web browsers, as well as wearable devices.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules.

Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

determining at least one microphone is impaired by analysing at least one audio signal from the at least one microphone, wherein analysing the at least one audio signal from the at least one microphone comprises:

generating a histogram comparing a power level for the at least one audio signal from the at least one microphone over time;

determining whether the generated histogram has collected valid data to reflect the power level for the at least one audio signal;

detecting at least one histogram peak and a value greater than a defined threshold based on the collected valid data; and determining a position of the detected at least one histogram peak occurs outside a defined normal operational range for the microphone, the defined normal operational range indicating when the at least one microphone is operating correctly or as expected;

determining an indicator based on the determination of the impairment of the at least one microphone; and applying the indicator based on the determination of the impairment of the at least one microphone, such that the at least one audio signal is processed based on the indicator.

2. The method as claimed in claim 1, wherein analysing at least one audio signal from the at least one microphone comprises determining a signal level of the at least one audio signal from the at least one microphone differs in more than an expected range of variation compared to a defined threshold value.

3. The method as claimed in claim 2, wherein the defined threshold value is a historical signal level for the at least one microphone.

4. The method as claimed in claim 2, wherein the signal level comprises a signal level ratio between at least two frequency band signal levels and wherein the defined threshold value is a frequency band ratio value.

5. The method as claimed in claim 1, wherein the at least one microphone is a first microphone and a second microphone from at least two microphones and analysing at least one audio signal from the at least one microphone comprises determining a signal level difference between the at least one audio signal from the first microphone of the at least two microphones and at least one further audio signal from the second microphone of the at least two microphones is greater than or equal to a defined threshold value.

6. The method as claimed in claim 5, wherein determining the signal level difference comprises determining the signal level difference greater than or equal to the defined threshold value over a defined period of time.

7. The method as claimed in claim 5, wherein determining the signal level difference comprises:

generating at least one signal level difference between the at least one audio signal from the first microphone of the at least two microphones and at least one further audio signal from the second microphone of the at least two microphones for at least one frequency band;

comparing the at least one frequency band at the at least one signal level difference against an associated frequency band threshold value; and determining the first microphone of the at least two microphones is impaired based on the comparison of the at least one frequency band at the at least one signal level difference being greater than the associated frequency band threshold value.

8. The method as claimed in claim 1, wherein the at least one microphone comprises a first microphone and a second microphone from at least two microphones, and determining the at least one microphone is impaired comprises:

generating a histogram comparing a spectral power level difference between the at least one audio signal from the first microphone of the at least two microphones and at least one further audio signal from the second microphone of the at least two microphones over time;

detecting at least one histogram peak with a value greater than a defined threshold; and determining the position of the detected at least one histogram peak occurs outside a defined normal operational range for the first microphone and the second microphone, the defined normal operational range indicating when the at least one audio signal from the first microphone and at least one further audio signal from the second microphone have a similar spectral power level.

9. The method as claimed in claim 8, wherein the position of the detected at least one histogram peak is a frequency range bin for a spectral power level difference between the at least one audio signal from the first microphone and the at least one further audio signal from the second microphone.

10. The method as claimed in claim 8, wherein the position of the detected at least one histogram peak is a time period range for a spectral power level difference between the at least one audio signal from the first microphone and the at least one further audio signal from the second microphone.

11. The method as claimed in claim 1, wherein determining the at least one microphone is impaired further comprises:

determining an object in proximity to at least one microphone port associated with the at least one microphone; and determining the at least one microphone is the impaired based on the determined object.

12. The method as claimed in claim 1, wherein determining the indicator based on the determination of the impairment of the at least one microphone comprises:

determining at least one control parameter for the at least one microphone; and determining at least one display parameter for the at least one microphone.

13. The method as claimed in claim 12, wherein determining the at least one control parameter for the at least one microphone comprises at least one:

determining a first switch control parameter for a first switch configured to receive the audio signal from the at least one microphone;

determining a first mixer control parameter for a first mixer configured to receive the audio signal from the at least one microphone;

determining a first amplifier control parameter for a first amplifier configured to receive the audio signal from the at least one microphone; and determining a first filter control parameter for a first filter configured to receive the audio signal from the at least one microphone.

14. The method as claimed in claim 1, wherein applying the indicator comprises processing the at least one audio signal based on at least one of:

applying a first switch control parameter for a first switch configured to receive the audio signal from the at least one microphone;

applying a first mixer control parameter for a first mixer configured to receive the audio signal from the at least one microphone;

applying a first amplifier control parameter for a first amplifier configured to receive the audio signal from the at least one microphone; and applying a first filter control parameter for a first filter configured to receive the audio signal from the at least one microphone.

15. The method as claimed in claim 1, wherein determining the indicator based on the determination of the impairment of the at least one microphone comprises generating a display message indicating the at least one microphone is impaired and wherein applying the indicator comprises generating on a display the display message.

16. The method as claimed in claim 15, wherein applying the indicator comprises at least one of:

an indicator that at least one further microphone signal is selected; and an indicator that the at least one audio signal from the at least one microphone is impaired; and wherein the audio signal from the at least one microphone signal is stopped.

17. The method as claimed in claim 1, wherein analysing the at least one audio signal from the at least one microphone comprises determining at least one of:

at least one microphone signal characteristics are different from at least one further microphone signal characteristics;

the at least one microphone is partially blocked;

the at least one microphone is fully blocked;

the at least one microphone is in audio shadow;

the at least one microphone is faulty; and the at least one microphone is providing inaccurate data.

18. An apparatus comprising:

a detector configured to determine at least one microphone is impaired by analysing at least one audio signal from the at least one microphone, wherein by analysing the at least one audio signal from the at least one microphone, the detector is further configured to:

generate a histogram comparing a power level for the at least one audio signal from the at least one microphone over time;

determine whether the generated histogram has collected valid data to reflect the power level for the at least one audio signal;

detect at least one histogram peak and a value greater than a defined threshold based on the collected valid data; and determine a position of the detected at least one histogram peak occurs outside a defined normal operational range for the microphone, the defined normal operational range indicating when the at least one microphone is operating correctly or as expected;

an controller configured to determine an indicator based on the determination of the impairment of the at least one microphone; and configured to apply the indicator based on the determination of the impairment of the at least one microphone, such that the at least one audio signal is processed based on the indicator.

19. An apparatus comprising at least one processor and at least one memory including computer code for one or more programs, the at least one memory and the computer code configured to with the at least one processor cause the apparatus at least to:

determine at least one microphone is impaired by analysing at least one audio signal from the at least one microphone, wherein by analysing the at least one audio signal from the at least one microphone, the at least one processor further causes the apparatus to:

generate a histogram comparing a power level for the at least one audio signal from the at least one microphone over time;

determine whether the generated histogram has collected valid data to reflect the power level for the at least one audio signal;

detect at least one histogram peak and a value greater than a defined threshold based on the collected valid data; and determine a position of the detected at least one histogram peak occurs outside a defined normal operational range for the microphone, the defined normal operational range indicating when the at least one microphone is operating correctly or as expected;

determine an indicator based on the determination of the impairment of the at least one microphone; and apply the indicator based on the determination of the impairment of the at least one microphone, such that the at least one audio signal is processed based on the indicator.

* * * * *